US006859185B2

(12) United States Patent
Royalty

(10) Patent No.: US 6,859,185 B2
(45) Date of Patent: Feb. 22, 2005

(54) ANTENNA ASSEMBLY DECOUPLING POSITIONERS AND ASSOCIATED METHODS

(75) Inventor: James Malcolm Bruce Royalty, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 55 days.

(21) Appl. No.: 10/458,851

(22) Filed: Jun. 11, 2003

(65) Prior Publication Data

US 2004/0252067 A1 Dec. 16, 2004

(51) Int. Cl.[7] ..... H01Q 3/00
(52) U.S. Cl. ..... 343/757; 343/765
(58) Field of Search ..... 343/757, 765, 343/772, 880, 882

(56) References Cited

U.S. PATENT DOCUMENTS

| | | | | | |
|---|---|---|---|---|---|
| 3,987,452 | A | | 10/1976 | Godet | 343/765 |
| 4,035,805 | A | | 7/1977 | Mobley | 343/117 |
| 4,126,865 | A | | 11/1978 | Longhurst et al. | 343/766 |
| 4,156,241 | A | | 5/1979 | Mobley et al. | 343/100 |
| 4,596,989 | A | | 6/1986 | Smith et al. | 343/709 |
| 4,823,134 | A | | 4/1989 | James et al. | 342/359 |
| 4,920,349 | A | * | 4/1990 | Le Gall | 343/709 |
| 5,419,521 | A | | 5/1995 | Matthews | 248/278 |
| 5,517,204 | A | * | 5/1996 | Murakoshi et al. | 343/765 |
| 5,670,967 | A | * | 9/1997 | Sarjala | 343/757 |
| 5,769,020 | A | | 6/1998 | Shields | 114/121 |
| 5,922,039 | A | * | 7/1999 | Welch et al. | 701/116 |
| 5,948,044 | A | | 9/1999 | Varley et al. | 701/220 |
| 6,002,364 | A | | 12/1999 | Kroeger et al. | 342/359 |
| 6,122,595 | A | | 9/2000 | Varley et al. | 701/220 |
| 6,195,060 | B1 | | 2/2001 | Spano et al. | 343/766 |
| 6,198,452 | B1 | | 3/2001 | Beheler et al. | 343/757 |
| 6,433,736 | B1 | * | 8/2002 | Timothy et al. | 342/359 |

FOREIGN PATENT DOCUMENTS

| | | | |
|---|---|---|---|
| EP | 0 296 322 | 12/1988 | H01Q/3/08 |
| EP | 1 134 839 | 9/2001 | H01Q/3/08 |

OTHER PUBLICATIONS

L–3 Communications Systems–West; "Multi–band Shipboard 3 Axis Terminal", Apr. 2002; pp. 33–34.

Frank D'Souza, "Control Design with Output Feedback", ©1998 by Prentice–Hall, Inc., New Jersey, USA; Chapter 7, sections 7.7 and 7.8.

John Blakelock, "Multivariable Control Systems", ©1991 by John Wiley & Sons, Inc.; Chapter 10, pp. 382–402.

* cited by examiner

*Primary Examiner*—Don Wong
*Assistant Examiner*—Minh Dieu A
(74) *Attorney, Agent, or Firm*—Allen, Dyer, Doppelt, Milbrath & Gilchrist, P.A.

(57) ABSTRACT

An antenna assembly for operation on a moving platform includes a base to be mounted on the moving platform, an azimuthal positioner extending upwardly from the base, and a canted cross-level positioner extending from the azimuthal positioner at a cross-level cant angle canted from perpendicular. The canted cross-level positioner may be rotatable about a cross-level axis to define a roll angle resulting in coupling between the azimuthal and canted cross-level positioners. The antenna assembly may also include an elevational positioner connected to the canted cross-level positioner resulting in coupling between the elevational and the azimuthal positioners because of the roll angle. An antenna may be connected to the elevational positioner. A controller operates the azimuthal, canted cross-level, and elevational positioners to aim the antenna along a desired line-of-sight and while decoupling at least one of the azimuthal and canted cross-level positioners, and the azimuthal and elevational positioners.

29 Claims, 15 Drawing Sheets

ANTENNA ASSEMBLY DECOUPLING POSITIONERS AND ASSOCIATED METHODS

FIELD OF THE INVENTION

The present invention relates to the field of antennas, and, more specifically, to the field of antenna positioner control systems, and related methods.

BACKGROUND OF THE INVENTION

An antenna stabilization system is generally used when mounting an antenna on an object that is subject to pitch and roll motions, such as a ship at sea, a ground vehicle, an airplane, or a buoy, for example. It is desirable to maintain a line-of-sight between the antenna and a satellite, for example, to which it is pointed. The pointing direction of an antenna mounted on a ship at sea, for example, is subject to rotary movement of the ship caused by changes in the ship's heading, as well as to the pitch and roll motion caused by movement of the sea.

U.S. Pat. No. 4,156,241 to Mobley et al. discloses a satellite antenna mounted on a platform on a surface of a ship. The antenna is stabilized and decoupled from motion of the ship using sensors mounted on the platform. U.S. Pat. No. 5,769,020 to Shields discloses a system for stabilizing platforms on board a ship. More specifically, the antenna is carried by a platform on the deck of the ship having a plurality of sensors thereon. The sensors on the platform cooperate with a plurality of sensors in a hull of the ship to sense localized motion due to pitch, roll, and variations from flexing of the ship to make corrections to the pointing direction of the antenna.

U.S. Pat. No. 4,596,989 to Smith et al. discloses an antenna system that includes an acceleration displaceable mass to compensate for linear acceleration forces caused by motion of a ship. The system senses motion of the ship and attempts to compensate for the motion by making adjustments to the position of the antenna.

U.S. Pat. No. 6,433,736 to Timothy, et al. discloses an antenna tracking system including an attitude and heading reference system that is mounted directly to an antenna or to a base upon which the antenna is mounted. The system also includes a controller connected to the attitude heading reference system. Internal navigation data is received from the attitude heading reference system. The system searches, and detects a satellite radio frequency beacon, and the controller initiates self scan tracking to point the antenna reflector in a direction of the satellite.

An antenna stabilization system may include an azimuthal positioner, a cross-level positioner connected thereto, an elevational positioner connected to the cross-level positioner, and an antenna connected to the elevational positioner. The system may also include respective motors to move the azimuthal, cross-level, and elevational positioner so that a line-of-sight between the antenna and a satellite is maintained.

It has been found, however, that movement of one of the positioners may cause undesired movement of another positioner, i.e., the azimuthal positioner may be coupled to the cross-level positioner, or the elevational positioner. Accordingly, larger, more powerful motors have been used to compensate for the undesired motion. It has also been found, however, that the use of larger motors may cause overcompensation, and an accumulation of undesired movement, which may increase errors in the pointing direction.

A tachometer feedback configuration, including a base-mounted inertial reference sensor (BMIRS), has been used to reduce the coupling between positioners. This configuration, however, may increase pointing errors due to misalignments, phasing, scaling and structural deflections between the BMIRS and the positioners.

SUMMARY OF THE INVENTION

In view of the foregoing background, it is therefore an object of the present invention to provide an antenna assembly for accurately and reliably pointing an antenna along a desired line-of-sight.

This and other objects, features, and advantages in accordance with the present invention are provided by an antenna assembly for operation on a moving platform and wherein a controller decouples at least two positioners. More particularly, the antenna assembly may comprise a base to be mounted on the moving platform, an azimuthal positioner extending upwardly from the base, and a canted cross-level positioner extending from the azimuthal positioner at a cross-level cant angle canted from perpendicular. The canted cross-level positioner may be rotatable about a cross-level axis to define a roll angle, resulting in coupling between the azimuthal positioner and the canted cross-level positioner. An elevational positioner may be connected to the canted cross-level positioner. Again, coupling will result between the elevational positioner and the azimuthal positioner because of the roll angle.

The antenna assembly may also comprise an antenna, such as a reflector antenna, connected to the elevational positioner. A controller may operate the azimuthal, canted cross-level, and elevational positioners to aim the antenna along a desired line-of-sight. Moreover, the controller may also decouple at least one of the azimuthal and canted cross-level positioners, and the azimuthal and elevational positioners. Decoupling the positioners advantageously allows for more accurate pointing of the antenna assembly along the desired line-of-sight and without requiring excessive corrective motion of the positioners.

The elevational positioner may comprise an azimuthal gyroscope associated therewith, and the canted cross-level positioner may comprise a cross-level motor and cross-level tachometer associated therewith. Accordingly, the controller may decouple based upon the azimuthal gyroscope and the cross-level tachometer. More specifically, the controller may decouple based upon the roll angle and an elevation angle defined by the desired line-of-sight being within respective first predetermined ranges.

The elevational positioner may also comprise a cross-level gyroscope associated therewith, and the azimuthal positioner may comprise an azimuthal motor and an azimuthal tachometer associated therewith. Accordingly, the controller may decouple based upon the cross-level gyroscope and the azimuthal tachometer. More specifically, the controller may decouple based upon the roll angle and an elevation angle defined by the desired line-of-sight being within respective second predetermined ranges.

Each of the azimuthal, canted cross-level, and elevational positioners may comprise respective motors and tachometers associated therewith, and the controller may decouple based upon the tachometers. More specifically, the controller may decouple based upon the roll angle and an elevation angle defined by the desired line-of-sight being within third predetermined ranges.

The elevational positioner may comprise an azimuthal gyroscope, a cross-level gyroscope, and an elevational gyroscope associated therewith. Accordingly, the controller may advantageously decouple the positioners of the antenna assembly based upon at least some of the gyroscopes and tachometers.

Considered in somewhat different terms, the present invention is directed to an antenna positioning assembly comprising at least a first and second positioner non-orthogonally connected together thereby coupling the first and second positioners to one another. The antenna positioning assembly may also comprise a controller for operating the positioners to aim an antenna along a desired line-of-sight while decoupling the at least first and second positioners.

A method aspect of the present invention is for operating an antenna assembly comprising a plurality of positioners. The plurality of positioners may comprise at least first and second positioners non-orthogonally connected together thereby coupling the first and second positioners to one another. The method may comprise controlling the positioners to aim an antenna connected thereto along a desired line-of-sight and while decoupling the at least first and second positioners.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notations are used in the graphs to refer to modeled readings resulting after decoupling.

Figure 1:
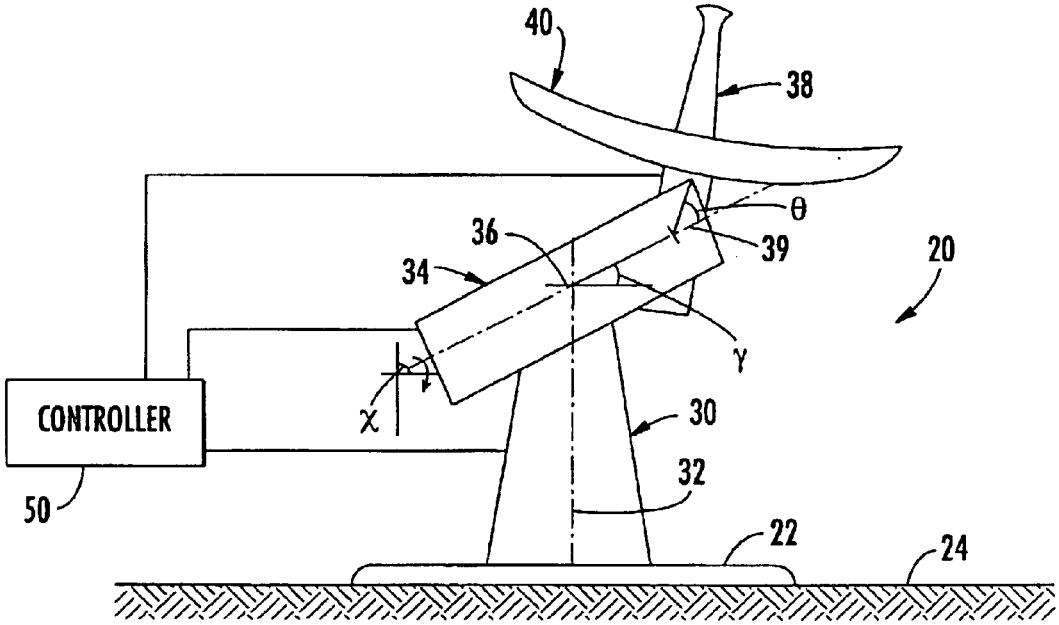
FIG. 1 is a schematic diagram of an antenna assembly according to the present invention.
Figure 2:
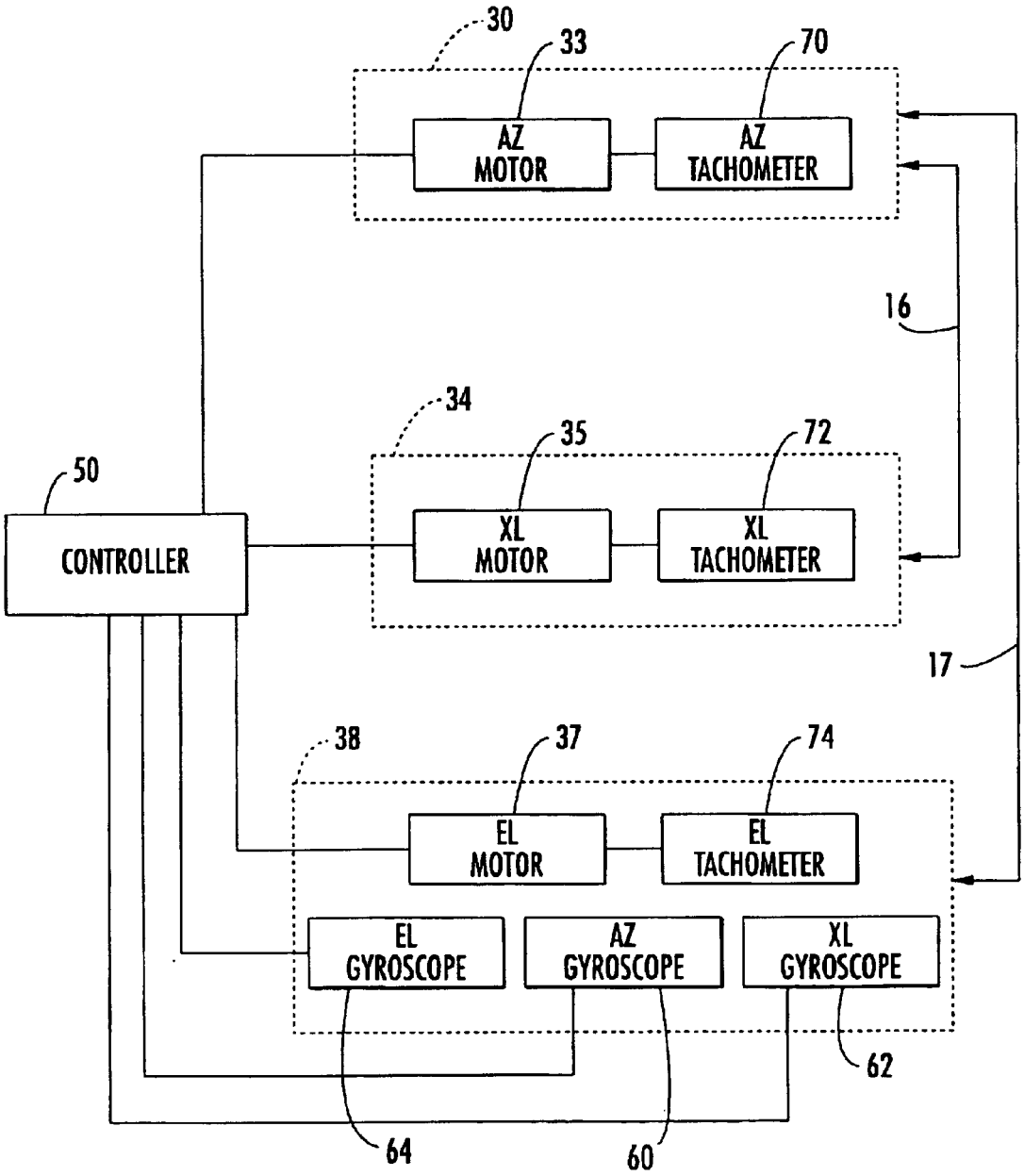
FIG. 2 is a more detailed schematic block diagram of the antenna assembly shown in FIG. 1.

Referring initially to FIGS. 1–2, an antenna assembly 20 for operation on a moving platform 24 is now described. The antenna assembly 20 illustratively includes a base 22 mounted to a moving platform 24. The moving platform 24 may, for example, be a deck of a ship at sea, a buoy, a land vehicle traveling across terrain, or any other moving platform as understood by those skilled in the art.

The antenna assembly 20 illustratively includes an azimuthal positioner 30 extending upwardly from the base 22. The azimuthal positioner 30 has an azimuthal axis 32 about which the azimuthal positioner may rotate.

A canted cross-level positioner 34 illustratively extends from the azimuthal positioner 30 at a cross-level cant angle $\gamma$ canted from perpendicular. The canted cross-level positioner 34 has a cross-level axis 36 about which the canted cross-level positioner may rotate and is generally referred to by those skilled in the art as roll. The angel defined by the roll of the canted cross-level positioner 34 defines a roll angle $\chi$ resulting in coupling between the canted cross-level positioner and the azimuthal positioner, as illustrated by the arrow 16 in FIG. 2. As will be discussed in greater detail below, the cross-level cant angle $\gamma$ may be between a range of about 30 to 60 degrees from perpendicular. The amount of coupling between the azimuthal positioner 30 and the canted-cross-level positioner 32 is affected by the roll angle $\chi$.

An elevational positioner 38 is illustratively connected to the canted cross-level positioner 34. This also results in coupling between the elevational positioner 38 and the azimuthal positioner 30 because of the roll angle $\chi$, as illustrated by the arrow 17 in FIG. 2. The amount of coupling between the elevational positioner 38 and the azimuthal positioner 30 is affected by the roll angle $\chi$, as well as the cross-level cant angle $\gamma$. The elevational positioner 38 includes an elevational axis 39 about which the elevational positioner may rotate. The rotation of the elevational positioner 38 about the elevational axis 39 allows the antenna assembly 20 to make elevational adjustments.

The antenna assembly illustratively includes an azimuthal gyroscope 60, a cross-level gyroscope 62, and an elevational gyroscope 64. More particularly, the azimuthal gyroscope 60, the cross-level gyroscope 62, and the elevational gyroscope 64 are mounted on the elevational positioner 38. The elevational gyroscope 64 is in line with the elevation angle of the line-of-sight of the elevational positioner 38 as caused by movement thereof. The azimuthal gyroscope 60 is in line with the azimuthal angle of the line-of-sight of the elevational positioner as caused by movement of the azimuthal positioner 30 and the cross-level positioner 34. The cross-level gyroscope 62 is in line with roll angle of the line-of-sight of the elevational positioner 38 as caused by movement of the canted cross-level positioner 34 and the azimuthal positioner 30. Further, each of the azimuthal positioner 30, the canted cross-level positioner 34, and the elevational positioner 38 illustratively comprises a motor 33, 35, 37 and a tachometer 70, 72, 74 associated therewith.

An antenna 40 is illustratively connected to the elevational positioner 38. The antenna 40 may be a reflector antenna, for example, suitable for receiving signals from a satellite, or any other type of antenna as understood by those skilled in the art. Rotation about the azimuthal axis 32, the cross-level axis 34, and the elevational axis 39 advantageously allows the antenna 40 to be pointed in any direction to provide accurate line-of-sight aiming between the antenna and the satellite, for example. This may be especially advantageous in cases where the antenna is mounted on a rotating platform.

Line of sight kinematics are developed below to provide a better understanding of the interaction between the azimuthal 30, the canted cross-level 34, and the elevational positioners 38:

$$\begin{Bmatrix}\omega_x\\ \omega_y\\ \omega_z\end{Bmatrix}_{LOS} = E[\theta]\left\{E[\chi]E[\gamma]\begin{Bmatrix}\omega_x\\ \omega_y\\ \omega_z\end{Bmatrix}_{AZ} + \dot{\chi}\begin{Bmatrix}1\\ 0\\ 0\end{Bmatrix}\right\} + \dot{\theta}\begin{Bmatrix}0\\ 1\\ 0\end{Bmatrix}.$$

These kinematics assume a stationary base, accordingly:

$\omega_x^A=\omega_y^A=0$ and $\omega_z^A\neq 0$ (azimuthal positioner inertial rate)

In these equations, the superscript E represents the elevational positioner, $\chi$ represents cross-level positioner, and A represents azimuthal positioner.

The cross-level positioner inertial rates are extracted from the following:

$$\omega_z^X=\omega_z^A c\gamma$$

$$\omega_x^X=-\omega_z^A s\gamma+\dot{\chi}$$

The above equations provide a relative rate as measured by the cross-level positioner tachometer 72 using the following equations:

$$\dot{\chi}=\omega_z^A s\gamma+\omega_x^X$$

$$\begin{Bmatrix}\omega_x\\ \omega_y\\ \omega_z\end{Bmatrix}_{LOS} = \begin{Bmatrix}\omega_x^X c\theta-\omega_z^A c\gamma s\theta c\chi\\ \omega_z^A c\gamma s\chi+\dot{\theta}\\ \omega_x^X s\theta+\omega_z^A c\gamma c\theta c\chi\end{Bmatrix}$$

The above equations provide the elevational positioner 38 relative rate as measured by the elevational tachometer 74 using the following equation:

$$\dot{\theta}=\omega_y^E-\omega_z^A c\gamma s\chi$$

$$\begin{Bmatrix}\dot{\omega}_x\\ \dot{\omega}_y\\ \dot{\omega}_z\end{Bmatrix}_{LOS} = \begin{Bmatrix}\dot{\omega}_x\\ \dot{\omega}_y\\ \dot{\omega}_z\end{Bmatrix}_{EL} = \begin{Bmatrix}\dot{\omega}_x^X c\theta-\dot{\omega}_z^A c\gamma s\theta c\chi\\ \dot{\omega}_y^E\\ \dot{\omega}_x^X s\theta+\dot{\omega}_z^A c\gamma c\theta c\chi\end{Bmatrix};$$

rate*rate terms≈0

$$\begin{Bmatrix}\dot{\omega}_x\\ \dot{\omega}_y\\ \dot{\omega}_z\end{Bmatrix}_{XL} = \begin{Bmatrix}\dot{\omega}_x^X\\ c\gamma s\chi\dot{\omega}_z^A\\ c\gamma c\chi\dot{\omega}_z^A\end{Bmatrix};$$

rate*rate terms≈0

Figure 3:
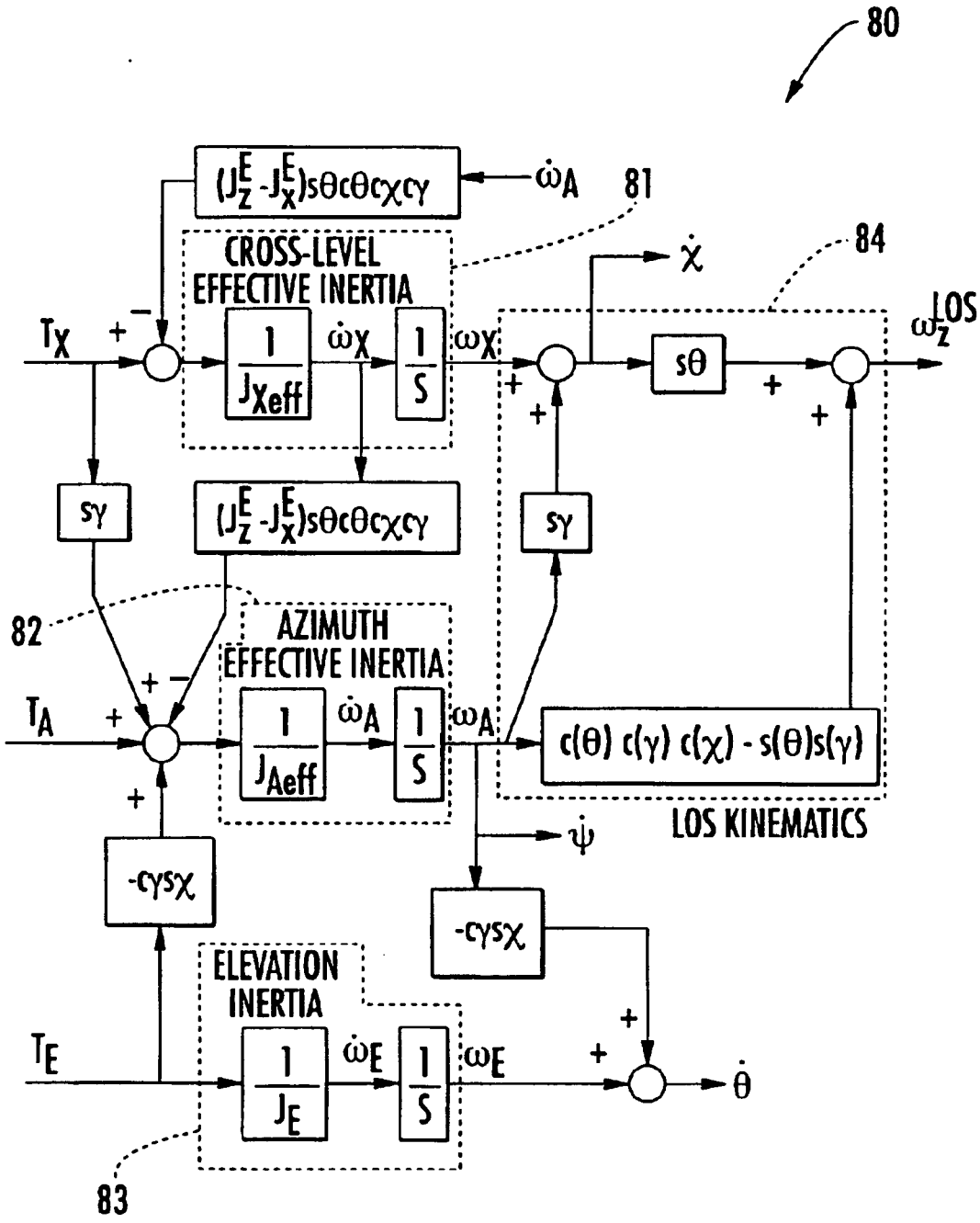
FIG. 3 is a schematic block diagram illustrating coupling between an azimuthal and canted cross-level positioner of the antenna assembly shown in FIG. 1.

Torques for the azimuthal positioner 30, the canted cross-level positioner 34, and the elevational positioner 38, may be calculated from the equations shown, for clarity of explanation, in the block diagram 80 of FIG. 3. More specifically, these derivations provide line-of-sight kinematics 85, which, as will be described in greater detail below, are used in subsequent derivations. In the following equations, $\gamma$ is the fixed elevational cant, $\chi$ is the roll angle, $\psi$ is the azimuthal angle, and $\theta$ is the elevational angle.

The torques on each of the elevational 38, canted cross-level 34, and azimuthal 30 positioners are now developed. The torque on the elevational positioner is developed from the following equations:

$$T_{EL} = \frac{dH_{EL}}{dt} = I_{EL}\dot{\omega}_{EL} + \omega_{EL}\times I_{EL}\omega_{EL}$$

$$\begin{Bmatrix}T_x\\ T_y\\ T_z\end{Bmatrix}_{EL} = \begin{bmatrix}I_x & I_{xy} & I_{xz}\\ I_{xy} & I_y & I_{yz}\\ I_{zx} & I_{zy} & I_z\end{bmatrix}_{EL}\begin{Bmatrix}\dot{\omega}_x\\ \dot{\omega}_y\\ \dot{\omega}_z\end{Bmatrix}_{EL} + \begin{Bmatrix}\omega_x\\ \omega_y\\ \omega_z\end{Bmatrix}_{EL}\times\begin{bmatrix}I_x & I_{xy} & I_{xz}\\ I_{yx} & I_y & I_{yz}\\ I_{zx} & I_{zy} & I_z\end{bmatrix}_{EL}\begin{Bmatrix}\omega_x\\ \omega_y\\ \omega_z\end{Bmatrix}_{EL}$$

The second term above is much smaller than the first term and, accordingly, is set to zero. The off diagonal terms in the inertia tensor are typically small and are considered zero for this analysis. Substituting for the elevational positioner 38 accelerations from the kinematics above produces the following equation:

$$\begin{Bmatrix}T_x\\ T_y\\ T_z\end{Bmatrix}_{EL} = \begin{bmatrix}I_x & 0 & 0\\ 0 & I_y & 0\\ 0 & 0 & I_z\end{bmatrix}_{EL}\begin{Bmatrix}\dot{\omega}_x^X c\theta-\dot{\omega}_z^A c\gamma s\theta c\chi\\ \dot{\omega}_y^E\\ \dot{\omega}_x^X s\theta+\dot{\omega}_z^A c\gamma c\theta c\chi\end{Bmatrix}$$

The elevational torques that act on the cross-level positioner 34 through the inverse transform to produce the following:

$$\begin{Bmatrix}T_x\\ T_y\\ T_z\end{Bmatrix}_{EL/XL} = \begin{bmatrix}c\theta & 0 & s\theta\\ 0 & 1 & 0\\ -s\theta & 0 & c\theta\end{bmatrix}\begin{Bmatrix}T_x\\ T_y\\ T_z\end{Bmatrix}_{EL}$$

$$= \begin{Bmatrix}(I_z^E s^2\theta + I_x^E c^2\theta)\dot{\omega}_x^X + c\gamma s\theta c\theta c\chi(I_z^E - I_x^E)\dot{\omega}_z^A\\ I_y^E\omega_y^E\\ c\gamma c\chi(I_z^E c^2\theta + I_x^E s^2\theta)\dot{\omega}_z^A + (I_z^E - I_x^E)s\theta c\theta\dot{\omega}_x^X\end{Bmatrix}$$

The torques about a cross-level axis 36 are determined as follows:

$$T_{mtr}^{X}-T_{x}^{EL/XL}=I_{x}^{X}\dot{\omega}_{x}^{X}$$

$$T_{mtr}^{X}-(I_{x}^{E}c^{2}\theta+I_{z}^{E}s^{2}\theta)\dot{\omega}_{x}^{X}-(I_{z}^{E})s\theta c\theta c\gamma c\chi\dot{\omega}_{z}^{A}=I_{x}^{X}\dot{\omega}_{x}^{X}$$

Collecting the $\dot{\omega}_{x}^{X}$ terms, the effective inertia 81 seen by the cross-level motor 35 is as follows:

$$J_{eff}^{X}=I_{x}^{X}+I_{x}^{E}c^{2}\theta+I_{z}^{E}s^{2}\theta$$

The sum of torques on the cross-level axis 36 is as follows:

$$\Sigma T_{XL}=T_{mtrXL}-(I_{z}^{E}-I_{x}^{E})s\theta c\theta c\gamma c\chi\dot{\omega}_{z}^{A}$$

The torques on the canted cross-level positioner 34 are as follows:

$$\begin{Bmatrix} T_x \\ T_y \\ T_z \end{Bmatrix}_{XL} = \begin{bmatrix} I_x & 0 & 0 \\ 0 & I_y & 0 \\ 0 & 0 & I_z \end{bmatrix}_{XL} \begin{Bmatrix} \dot{\omega}_x \\ \dot{\omega}_y \\ \dot{\omega}_z \end{Bmatrix}_{XL} = \begin{Bmatrix} I_x^X \dot{\omega}_x^X \\ I_y^X c\gamma s\chi \dot{\omega}_z^A \\ I_z^X c\gamma c\chi \dot{\omega}_z^A \end{Bmatrix}$$

Kinematic torques from the canted cross-level positioner 34 may operate through the inverse transform on the azimuthal positioner 30. In addition the reaction torques from the elevational positioner 38 to the canted cross-level positioner 34 operated through the canted roll angle $\chi$ and the cross-level cant angle $\gamma$. Accordingly, the following equations are produced:

$$\begin{Bmatrix} T_x \\ T_y \\ T_z \end{Bmatrix}_{XL/AZ} = \begin{bmatrix} c\gamma & 0 & s\gamma \\ 0 & 1 & 0 \\ -s\gamma & 0 & c\gamma \end{bmatrix} \begin{bmatrix} 1 & 0 & 0 \\ 0 & c\chi & -s\chi \\ 0 & s\chi & c\chi \end{bmatrix} \left( \begin{Bmatrix} T_x \\ T_y \\ T_z \end{Bmatrix}_{XL} + \begin{Bmatrix} T_x \\ T_y \\ T_z \end{Bmatrix}_{EL/XL} \right)$$

$$\begin{Bmatrix} T_x \\ T_y \\ T_z \end{Bmatrix}_{XL/AZ} = \begin{bmatrix} c\gamma & s\gamma s\chi & s\gamma c\chi \\ 0 & c\chi & -s\chi \\ -s\gamma & c\gamma s\chi & c\gamma c\chi \end{bmatrix} \left( \begin{Bmatrix} I_x^X \dot{\omega}_x^X \\ I_y^X c\gamma s\chi \dot{\omega}_z^A \\ I_z^X c\gamma c\chi \dot{\omega}_z^A \end{Bmatrix} + \begin{Bmatrix} (I_z^E s^2\theta + I_x^E c^2\theta)\dot{\omega}_x^X + c\gamma s\theta c\theta c\chi (I_z^E - I_x^E)\omega_z^A \\ I_y^E \dot{\omega}_y^E \\ c\gamma c\chi (I_z^E c^2\theta + I_x^E s^2\theta)\dot{\omega}_z^A + (I_z^E - I_R^E)s\theta c\theta \dot{\omega}_x^X \end{Bmatrix} \right)$$

The sum of the two vectors' x-terms is equal to the torque of the cross-level motor 35 as calculated above. The y-term in the second vector is equal to the cross-level motor torque.

The resulting z-term, as it acts on azimuthal axis 32, is as follows:

$$\begin{aligned} T_z^{XL/AZ} &= -T_{mtr}^{X}s\gamma + (T_y^X + T_{mtr}^E)c\gamma s\chi + (T_z^X + T_z^{EL/XL})c\gamma c\chi \\ &= -T_{mtr}^{X}s\gamma + (I_y^X\dot{\omega}_z^A c\gamma s\chi + T_{mtr}^E)c\gamma s\chi + \\ &\quad [I_z^X c\gamma c\chi\dot{\omega}_z^A + (I_z^E - I_x^E)s\theta c\theta\dot{\omega}_x^X + \\ &\quad (I_x^E s^2\theta + I_z^E c^2\theta)c\gamma c\chi\dot{\omega}_z^A]c\gamma c\chi \\ &= -T_{mtr}^{X}s\gamma + T_{mtr}^E c\gamma s\chi + (I_z^E - I_x^E)c\gamma c\chi s\theta c\theta\dot{\omega}_x^X + \\ &\quad [I_y^X c^2\gamma s^2\chi + (I_z^X + I_x^E s^2\theta + I_z^E c^2\theta)c^2\gamma c^2\chi]\dot{\omega}_z^A \end{aligned}$$

For azimuthal motion, the torques about the azimuthal axis 32 ($\Sigma F=ma$) are as follows:

$$T_{mtr}^{A}-T_{z}^{XL/AZ}=I_{z}^{A}\dot{\omega}_{z}^{A}$$

Collecting the $\dot{\omega}_{z}^{A}$ terms, the effective inertia seen by the azimuthal motor 32 is:

$$J_{eff}^{A}=I_{z}^{A}+I_{y}^{X}c^{2}\gamma s^{2}\chi+(I_{z}^{X}+I_{x}^{E}s^{2}\theta+I_{z}^{E}c^{2}\theta)c^{2}\gamma c^{2}\chi$$

The effective inertia seen by the elevational motor 37 is also illustrated. The sum of torques on the azimuthal axis 32 are as follows:

$$\Sigma T_{AZ}=T_{mtr}^{A}+T_{mtr}^{X}s\gamma-(I_{z}^{E}-I_{x}^{E})s\theta c\theta c\gamma c\chi\dot{\omega}_{x}^{X}-T_{mtr}^{E}c\gamma s\chi$$

Accordingly, and for clarity of explanation, the block diagram 80 illustrated in FIG. 3 is produced showing the relationship between the torques of the azimuthal motor 33 and the cross-level motor 35, and the line-of-sight inertial and relative rates 84, and the developed line-of-sight kinematics 85.

The antenna assembly 20 further includes a controller 50 for operating the azimuthal positioner 30, canted cross-level positioner 34, and the elevational positioner 38 to aim the antenna 40 along a desired line-of-sight. The controller 50 also decouples the azimuthal positioner 30 and canted cross-level positioner 34, and/or the azimuthal positioner and the elevational positioner 38. Decoupling the positioners 30, 34, 38, advantageously decreases undesired motion of one of the positioners due to desired motion of another one of the positioners. In other words, the motion and the torques of the positioners are no longer coupled.

Figure 4:
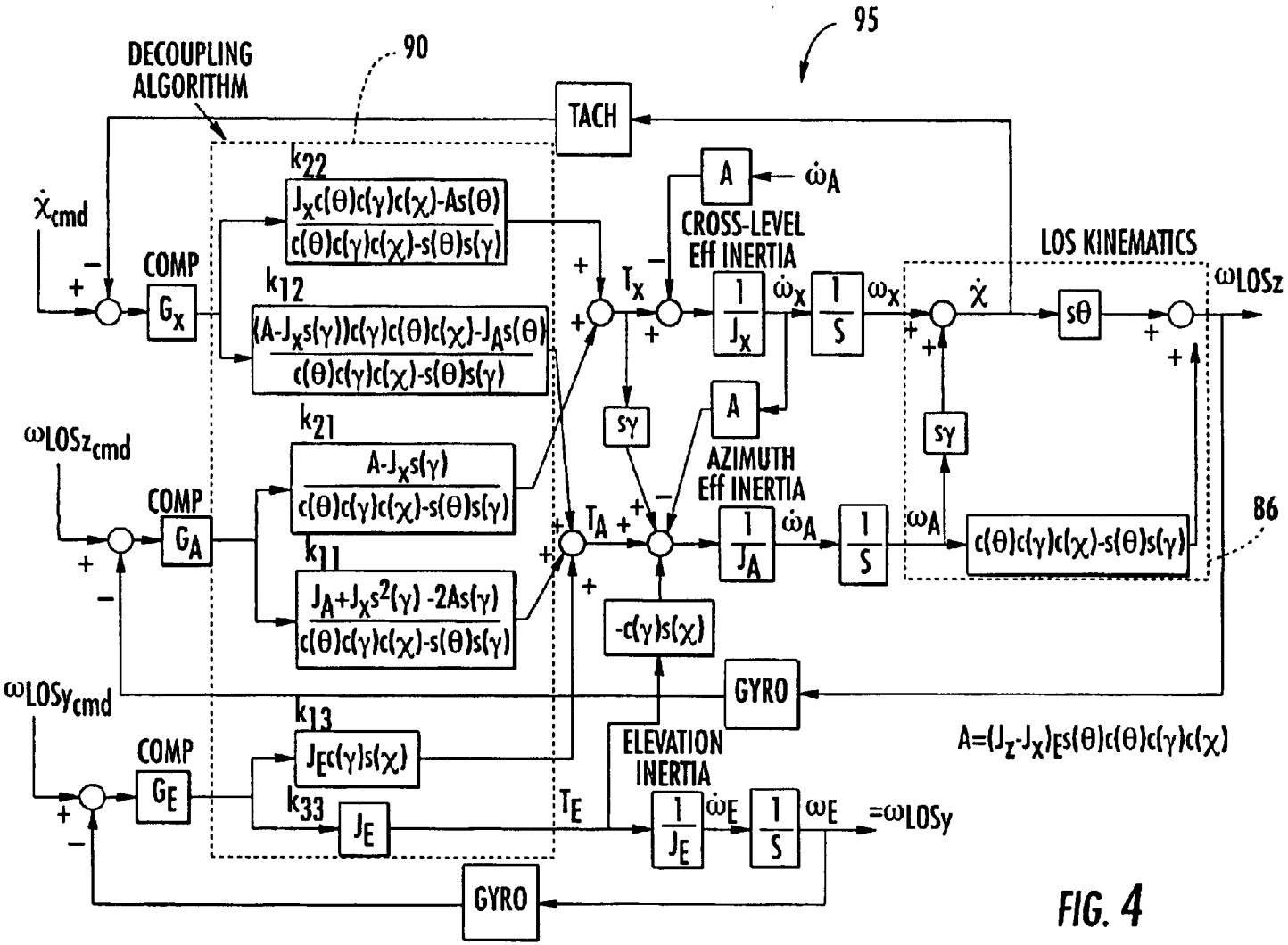
FIG. 4 is a schematic block diagram illustrating a low elevation line-of-sight stabilization control algorithm for controlling the antenna assembly shown in FIG. 1.

In one embodiment the controller 50 decouples using a low elevation line-of-sight stabilization control algorithm 90, shown for clarity of explanation in the block diagram 95 of FIG. 4. The controller 50 decouples based upon the azimuthal gyroscope 60 and the cross-level tachometer 72. More particularly, the controller 50 decouples based upon the cross-level cant angle $\gamma$ and an elevation angle $\theta$ defined by the desired line-of-sight being within predetermined ranges. For example, the line-of-sight elevation angle relative to the base may between about −30 and +70 degrees.

The block diagram 95 of FIG. 4 shows the low elevation line-of-sight stabilization control algorithm 90 for controlling the antenna assembly 20. Derivation of the low elevation line-of-sight stabilization control algorithm 90 is now described.

As noted above, when the azimuthal motor 33 torques, the azimuthal positioner 30 couples to the canted cross-level positioner 34. The line-of-sight kinematics 86 is illustrated in the block diagram 95 of FIG. 4. Derivation of the low elevation line-of-sight algorithm 90 begins with the following state equation:

$$\dot{x}=A_1x+Bu$$

In the above equation, $A_1$ is the transition matrix, x represents the states, u represents the motor torques, and B relates the motor torques to the state rates such that:

$$\begin{Bmatrix} \dot{\omega}_A \\ \dot{\omega}_X \\ \dot{\omega}_E \end{Bmatrix} = \begin{bmatrix} 0 & -\frac{A}{J_A} & 0 \\ -\frac{A}{J_X} & 0 & 0 \\ 0 & 0 & 0 \end{bmatrix} \begin{Bmatrix} \dot{\omega}_A \\ \dot{\omega}_X \\ \dot{\omega}_E \end{Bmatrix} + \begin{bmatrix} \frac{1}{J_A} & \frac{s(\gamma)}{J_A} & \frac{-c(\gamma)s(\chi)}{J_A} \\ 0 & \frac{1}{J_X} & 0 \\ 0 & 0 & \frac{1}{J_E} \end{bmatrix} \begin{Bmatrix} T_A \\ T_X \\ T_E \end{Bmatrix}$$

In the above equation, $A=(J_z^E-J_x^E)s\theta c\theta c\gamma c\chi$.

The angular accelerations are meant to be in the first term and are later placed on the left hand side of the equation for state consistency. Also, the variables, 'J' and 'I', are interchangeable as the mass moment of inertia. A measurement equation is as follows:

$$y=Cx+Du,$$

In the above equation, y is the measurement state, C relates the states to the measurements, and D relates the motor torques to the measurements:

$$\begin{Bmatrix} \omega_{LOSz} \\ \dot{\chi} \\ \omega_{LOSy} \end{Bmatrix} = \begin{bmatrix} c(\theta)c(\gamma)c(\chi) & s(\theta) & 0 \\ s(\gamma) & 1 & 0 \\ 0 & 0 & 1 \end{bmatrix} \begin{Bmatrix} \omega_A \\ \omega_X \\ \omega_E \end{Bmatrix} + \begin{bmatrix} 0 & 0 & 0 \\ 0 & 0 & 0 \\ 0 & 0 & 0 \end{bmatrix} \begin{Bmatrix} T_A \\ T_X \\ T_E \end{Bmatrix}$$

A matrix, k, is inserted before the motor torques, as follows:

$$\begin{Bmatrix} T_A \\ T_X \\ T_E \end{Bmatrix} = \begin{bmatrix} k_{11} & k_{12} & k_{13} \\ k_{21} & k_{22} & k_{23} \\ k_{31} & k_{32} & k_{33} \end{bmatrix} \begin{Bmatrix} U_{LOSz} \\ U_X \\ U_{LOSy} \end{Bmatrix}$$

Rewriting the state equation produces the following equation:

$$\begin{Bmatrix} \omega_A \\ \omega_X \\ \omega_E \end{Bmatrix} = \frac{1}{S} \begin{bmatrix} \frac{J_x}{J_A J_X - A^2} & \frac{-A + J_X s(\gamma)}{J_A J_X - A^2} & \frac{-J_X c(\gamma) s(\chi)}{J_A J_X - A^2} \\ \frac{-A}{J_A J_X - A^2} & \frac{-A s(\gamma) + J_A}{J_A J_X - A^2} & \frac{A c(\gamma) s(\chi)}{J_A J_X - A^2} \\ 0 & 0 & \frac{1}{J_E} \end{bmatrix} \begin{Bmatrix} T_A \\ T_X \\ T_E \end{Bmatrix}$$

The above state equation is now substituted into the measurement equation as follows:

$$\begin{Bmatrix} \omega_{LOSz} \\ \dot{\chi} \\ \omega_{LOSy} \end{Bmatrix} = \begin{bmatrix} c(\theta)c(\gamma)c(\chi) & s(\theta) & 0 \\ s(\gamma) & 1 & 0 \\ 0 & 0 & 1 \end{bmatrix} \frac{1}{S} \begin{bmatrix} \frac{J_X}{J_A J_X - A^2} & \frac{-A + J_X s(\gamma)}{J_A J_X - A^2} & \frac{-J_X c(\gamma) s(\chi)}{J_A J_X - A^2} \\ \frac{-A}{J_A J_X - A^2} & \frac{-A s(\gamma) + J_A}{J_A J_X - A^2} & \frac{A c(\gamma) s(\chi)}{J_A J_X - A^2} \\ 0 & 0 & \frac{1}{J_E} \end{bmatrix} \begin{Bmatrix} T_A \\ T_X \\ T_E \end{Bmatrix}$$

The above equation may be simplified for easier manipulation as follows:

$$\begin{Bmatrix} \omega_{LOSz} \\ \dot{\chi} \\ \omega_{LOSy} \end{Bmatrix} = \begin{bmatrix} a & b & 0 \\ c & 1 & 0 \\ 0 & 0 & 1 \end{bmatrix} \frac{1}{S} \begin{bmatrix} d & e & f \\ g & h & i \\ 0 & 0 & j \end{bmatrix} \begin{Bmatrix} T_A \\ T_X \\ T_E \end{Bmatrix}$$

The $k_{ij}$ matrix is substituted to produce the following:

$$\begin{Bmatrix} \omega_{LOSz} \\ \dot{\chi} \\ \omega_{LOSy} \end{Bmatrix} = \begin{bmatrix} a & b & 0 \\ c & 1 & 0 \\ 0 & 0 & 1 \end{bmatrix} \frac{1}{S} \begin{bmatrix} d & e & f \\ g & h & i \\ 0 & 0 & j \end{bmatrix} \begin{bmatrix} k_{11} & k_{12} & k_{13} \\ k_{21} & k_{22} & k_{23} \\ k_{31} & k_{32} & k_{33} \end{bmatrix} \begin{Bmatrix} U_{LOSz} \\ U_X \\ U_{LOSy} \end{Bmatrix}$$

The above is reduced as follows:

$$\begin{Bmatrix} \omega_{LOSz} \\ \chi \\ \omega_{LOSy} \end{Bmatrix} = \frac{1}{S} [\, column1 \quad column2 \quad column3 \,] \begin{Bmatrix} U_{LOSz} \\ U_X \\ U_{LOSx} \end{Bmatrix}$$

$$column1 = \begin{bmatrix} (ad + bg)k_{11} + (ae + bh)k_{21} + (af + bi)k_{31} \\ (cd + g)k_{11} + (ce + h)k_{21} + (cf + i)k_{31} \\ jk_{31} \end{bmatrix}$$

-continued $$column2 = \begin{bmatrix} (ad + bg)k_{12} + (ae + bh)k_{21} + (af + bi)k_{31} \\ (cd + g)k_{12} + (ce + h)k_{22} + (cf + i)k_{32} \\ jk_{32} \end{bmatrix}$$

$$column3 = \begin{bmatrix} (ad + bg)k_{13} + (ae + bh)k_{23} + (af + bi)k_{33} \\ (cd + g)k_{13} + (ce + h)k_{23} + (cf + i)k_{33} \\ jk_{33} \end{bmatrix}$$

It is desirable for the above matrix to be the identity matrix that will decouple the canted cross-level positioner 34 and the elevational positioner 38 from the azimuthal positioner 30, and visa-versa:

$$\begin{Bmatrix} \omega_{LOSz} \\ \chi \\ \omega_{LOSz} \end{Bmatrix} = \frac{1}{S} \begin{bmatrix} 1 & 0 & 0 \\ 0 & 1 & 0 \\ 0 & 0 & 1 \end{bmatrix} \begin{Bmatrix} U_{LOSz} \\ U_X \\ U_{LOSx} \end{Bmatrix}$$

This forms the following three equations:

$$\begin{bmatrix} ad + bg & ae + bh & af + bi \\ cd + g & ce + h & cf + i \\ 0 & 0 & j \end{bmatrix} \begin{Bmatrix} k_{11} \\ k_{21} \\ k_{31} \end{Bmatrix} = \begin{Bmatrix} 1 \\ 0 \\ 0 \end{Bmatrix}$$

-continued $$\begin{bmatrix} ad + bg & ae + bh & af + bi \\ cd + g & ce + h & cf + i \\ 0 & 0 & j \end{bmatrix} \begin{Bmatrix} k_{12} \\ k_{22} \\ k_{32} \end{Bmatrix} = \begin{Bmatrix} 0 \\ 1 \\ 0 \end{Bmatrix}$$

$$\begin{bmatrix} ad + bg & ae + bh & af + bi \\ cd + g & ce + h & cf + i \\ 0 & 0 & j \end{bmatrix} \begin{Bmatrix} k_{13} \\ k_{23} \\ k_{33} \end{Bmatrix} = \begin{Bmatrix} 0 \\ 0 \\ 1 \end{Bmatrix}$$

Solving for $k_{ij}$ produces the following:

$$k_{11} = \frac{1}{\Delta}(ce + h) = \frac{-2As\gamma + J_A + J_X s^2\gamma}{c\theta c\gamma c\chi - s\theta s\gamma}$$

$$k_{21} = \frac{-1}{\Delta}(cd + g) = \frac{A - J_X s\gamma}{c\theta c\gamma c\chi - s\theta s\gamma}$$

$$k_{31} = 0$$

$$k_{12} = \frac{-1}{\Delta}(ae + bh) = \frac{A(c\theta c\gamma c\chi + s\theta s\gamma) - J_A s\theta - J_X c\theta s\gamma c\gamma c\chi}{c\theta c\gamma c\chi - s\theta s\gamma}$$

$$k_{22} = \frac{1}{\Delta}(ad + bg) = \frac{J_X c\theta c\gamma c\chi - As\theta}{c\theta c\gamma c\chi - s\theta s\gamma}$$

$$k_{32} = 0$$

-continued $$k_{13} = \frac{-(-ei+fh)}{(dh-ge)j} = J_E c\gamma s\chi$$

$$k_{23} = \frac{(-di+fg)}{(dh-ge)j} = 0$$

$$k_{33} = \frac{1}{j} = J_E$$

In the above equation, $A=(J_z^E-J_x^E)s\theta c\theta c\gamma C\chi$.

For a fixed cant angle $\gamma$ of approximately 30 degrees, it is noted that the denominator goes to zero for a non-solution when $\chi$ is zero and the elevational angle $\theta$ is 60 degrees. Therefore, a singularity exists. To keep this from happening the controller 50 must switch before $\theta$ reaches 60 degrees, having the canted cross-level positioner 34 control the line-of-sight azimuthal rate and the azimuthal positioner 30 controlled in a relative rate or tach mode.

Accordingly, an operator may compensate as though the axes were orthogonal. The resulting control architecture is illustrated by the block diagram 95 of FIG. 4.

Figure 5:
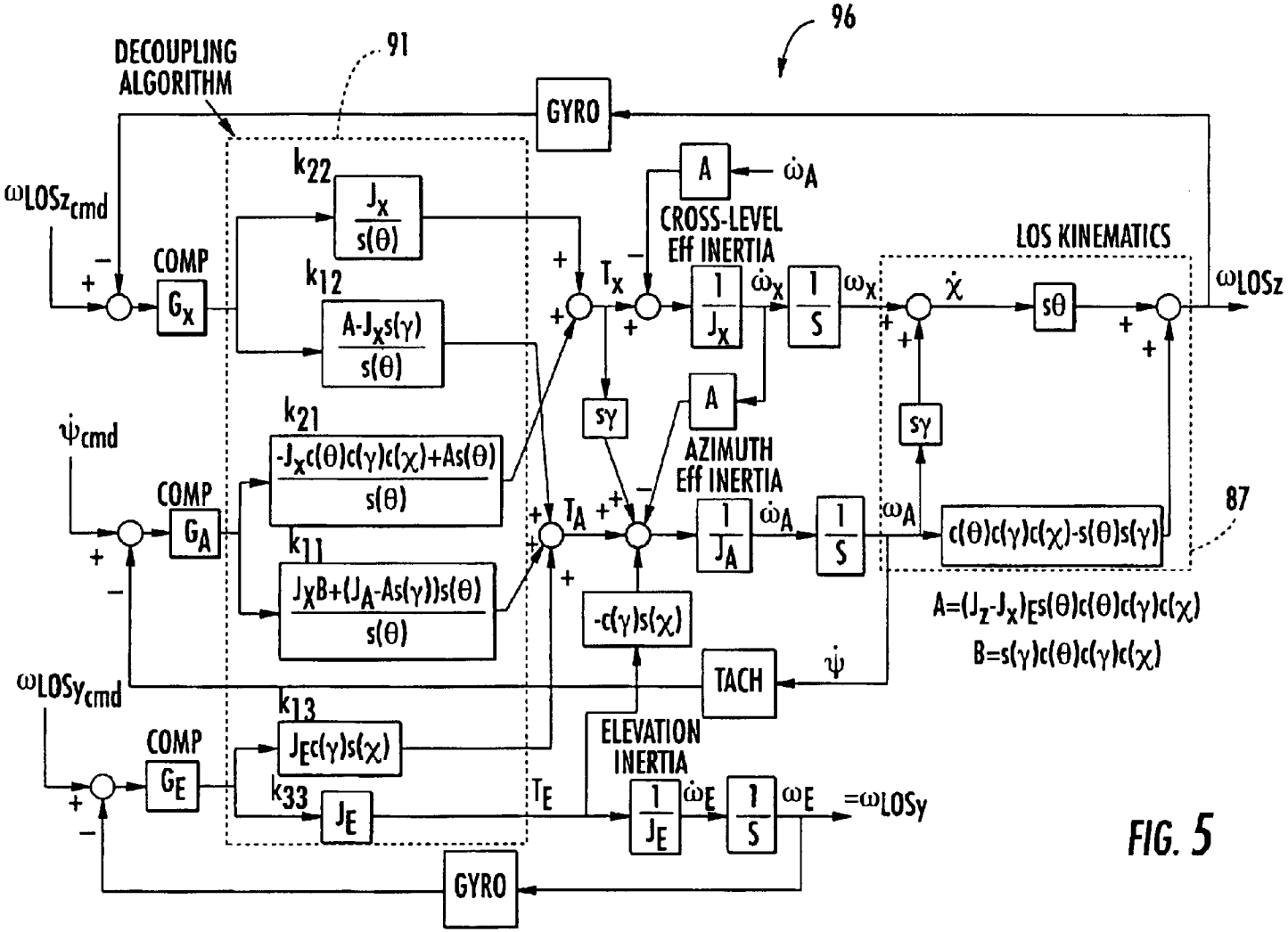
FIG. 5 is a schematic block diagram illustrating a high elevation line-of-sight stabilization control algorithm for controlling the antenna assembly shown in FIG. 1.

In another embodiment of the antenna assembly 20, the controller 50 decouples using a high elevation line-of-sight stabilization control illustrated for clarity of explanation in the block diagram 96 of FIG. 5. The line-of-sight kinematics 87 is also illustrated in the block diagram 96 of FIG. 5. The controller 50 decouples based upon the cross-level gyroscope 62 and the azimuthal tachometer 70. More particularly, the controller 50 decouples based upon the roll angle y and an elevation angle e defined by the desired line-of-sight being within predetermined ranges. For example, for a cant of 30 degrees the line-of-sight elevation angle relative to the base may between about +50 and +120 degrees.

A block diagram showing a high elevation line-of-sight stabilization control algorithm 91 for controlling the antenna assembly 20 is illustrated in FIG. 5. Derivation of the high elevation line-of-sight stabilization control algorithm 91 is now described.

At high elevation angles, the canted cross-level positioner 34 may be used to stabilize an azimuthal line of sight, and the azimuthal positioner 30 may be controlled in a relative rate mode. There may be a hysteresis or phasing region so that the switching between the positioners used to stabilize the line-of-sight does not occur rapidly. The measurement equation changes from the low elevation case (described above) to the following:

$$\begin{Bmatrix} \Psi \\ \omega_{LOSz} \\ \omega_{LOSy} \end{Bmatrix} = \begin{bmatrix} 1 & 0 & 0 \\ c(\theta)c(\gamma)c(\chi) & s(\theta) & 0 \\ 0 & 0 & 1 \end{bmatrix} \begin{Bmatrix} \omega_A \\ \omega_\chi \\ \omega_E \end{Bmatrix}$$

The dynamics (state equations) are the same and substituting into the measurement equation produces the following:

$$\begin{Bmatrix} \Psi \\ \omega_{LOSz} \\ \omega_{LOSy} \end{Bmatrix} = \begin{bmatrix} 1 & 0 & 0 \\ c(\theta)c(\gamma)c(\chi) & s(\theta) & 0 \\ 0 & 0 & 1 \end{bmatrix} \frac{1}{S} \begin{bmatrix} \frac{J_\chi}{J_A J_\chi - A^2} & \frac{-A + J_\chi s(\gamma)}{J_A J_\chi - A^2} & \frac{-J_\chi c(\gamma)s(\chi)}{J_A J_\chi - A^2} \\ \frac{-A}{J_A J_\chi - A^2} & \frac{-As(\gamma) + J_A}{J_A J_\chi - A^2} & \frac{Ac(\gamma)s(\chi)}{J_A J_\chi - A^2} \\ 0 & 0 & \frac{1}{J_E} \end{bmatrix} \begin{Bmatrix} T_A \\ T_\chi \\ T_E \end{Bmatrix}$$

Simplifying the above for easier manipulation produces the following:

$$\begin{Bmatrix} \Psi \\ \omega_{LOSz} \\ \omega_{LOSy} \end{Bmatrix} = \begin{bmatrix} 1 & 0 & 0 \\ a & b & 0 \\ 0 & 0 & 1 \end{bmatrix} \frac{1}{S} \begin{bmatrix} d & e & f \\ g & h & i \\ 0 & 0 & j \end{bmatrix} \begin{Bmatrix} T_A \\ T_\chi \\ T_E \end{Bmatrix}$$

Inserting the $k_{ij}$ matrix produces the following:

$$\begin{Bmatrix} \Psi \\ \omega_{LOSz} \\ \omega_{LOSy} \end{Bmatrix} = \begin{bmatrix} 1 & 0 & 0 \\ a & b & 0 \\ 0 & 0 & 1 \end{bmatrix} \frac{1}{S} \begin{bmatrix} d & e & f \\ g & h & i \\ 0 & 0 & j \end{bmatrix} \begin{bmatrix} k_{11} & k_{12} & k_{13} \\ k_{21} & k_{22} & k_{23} \\ k_{31} & k_{32} & k_{33} \end{bmatrix} \begin{Bmatrix} U_A \\ U_{LOSz} \\ U_{LOSy} \end{Bmatrix}$$

The above equation reduces to the following:

$$\begin{Bmatrix} \Psi \\ \omega_{LOSz} \\ \omega_{LOSy} \end{Bmatrix} = \frac{1}{S}[\text{column1} \quad \text{column2} \quad \text{column3}] \begin{Bmatrix} U_A \\ U_{LOSz} \\ U_{LOSy} \end{Bmatrix}$$

$$\text{column1} = \begin{bmatrix} dk_{11} + ek_{21} + fk_{31} \\ (ad+bg)k_{11} + (ae+bh)k_{21} + af + bi)k_{31} \\ jk_{31} \end{bmatrix}$$

$$\text{column2} = \begin{bmatrix} dk_{12} + ek_{22} + fk_{32} \\ (ad+bg)k_{12} + (ae+bh)k_{22} + af + bi)k_{32} \\ jk_{32} \end{bmatrix}$$

$$\text{column2} = \begin{bmatrix} dk_{13} + ek_{23} + fk_{33} \\ (ad+bg)k_{13} + (ae+bh)k_{23} + af + bi)k_{33} \\ jk_{33} \end{bmatrix}$$

This forms the following three equations:

$$\begin{bmatrix} d & e & f \\ ad+bg & ae+bh & af+bi \\ 0 & 0 & j \end{bmatrix} \begin{Bmatrix} k_{11} \\ k_{21} \\ k_{31} \end{Bmatrix} = \begin{Bmatrix} 1 \\ 0 \\ 0 \end{Bmatrix}$$

$$\begin{bmatrix} d & e & f \\ ad+bg & ae+bh & af+bi \\ 0 & 0 & j \end{bmatrix} \begin{Bmatrix} k_{12} \\ k_{22} \\ k_{32} \end{Bmatrix} = \begin{Bmatrix} 0 \\ 1 \\ 0 \end{Bmatrix}$$

$$\begin{bmatrix} d & e & f \\ ad+bg & ae+bh & af+bi \\ 0 & 0 & j \end{bmatrix} \begin{Bmatrix} k_{13} \\ k_{23} \\ k_{33} \end{Bmatrix} = \begin{Bmatrix} 0 \\ 0 \\ 1 \end{Bmatrix}$$

Solving for $k_{ij}$ produces the following:

$$k_{11} = -\frac{ae+bh}{\Delta} = \frac{c\theta c\gamma c\chi}{s\theta}(-A + J_\chi s\gamma) - As\gamma + J_A$$

$$k_{21} = \frac{ad+bg}{\Delta} = -\frac{J_\chi c\theta c\gamma c\chi}{s\theta} + A$$

-continued $$k_{31} = 0$$

$$k_{12} = \frac{e}{\Delta} = \frac{A - s\gamma J_X}{s\theta}$$

$$k_{22} = \frac{-d}{\Delta} = \frac{J_X}{s\theta}$$

$$k_{32} = 0$$

$$k_{13} = \frac{-ei + fh}{\Delta} = c\gamma s\chi J_E$$

$$k_{23} = \frac{di + fg}{\Delta} = 0$$

$$k_{33} = \frac{1}{j} = J_E$$

In the above equations, $A=(J_z^E-J_x^E)s\theta c\theta c\gamma c\chi$.

It should be noted that the denominator goes to zero for a non-solution when the elevation angle θ is 0 degrees. Therefore, a singularity exists. To keep this from happening the control must switch before the elevation angle θ reaches 0 degrees. The resulting control architecture is illustrated in FIG. 5.

Figure 6:
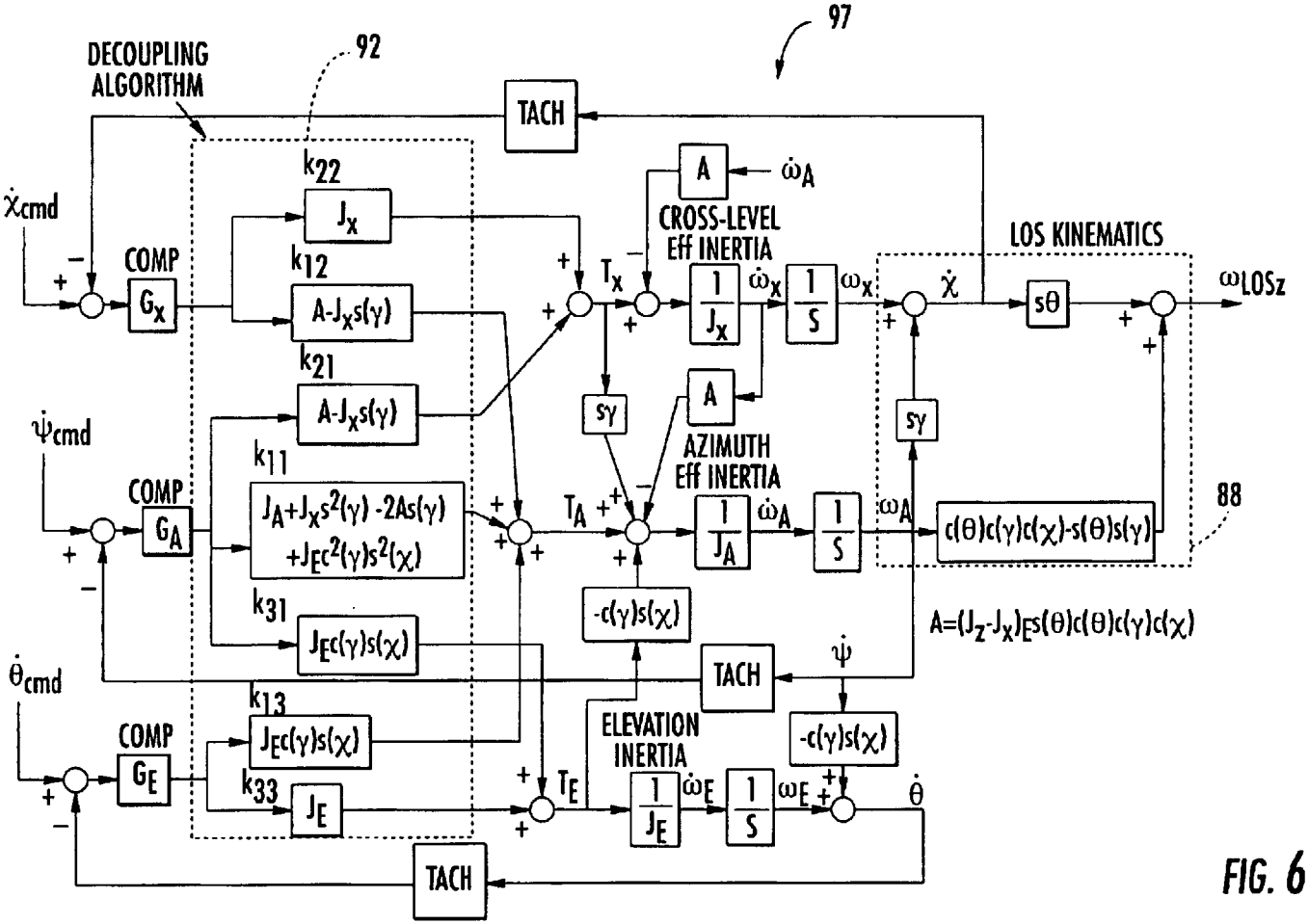
FIG. 6 is a schematic block diagram illustrating a tachometer feedback control algorithm for controlling the antenna assembly shown in FIG. 1.

In yet another embodiment of the antenna positioner 20, the controller 50 decouples using a tachometer feedback control algorithm 92 (FIG. 6). The controller 50 decouples based on the tachometers 70, 72, 74. For this embodiment the controller 50 decouples without regard to the elevation angle θ.

A block diagram 97 showing a tachometer feedback control algorithm 92 for controlling the antenna assembly 20 is illustrated, for clarity of explanation, in FIG. 6. The line-of-sight kinematics 80 is illustrated in the block diagram 97 of FIG. 7. Derivation of the tachometer feedback control algorithm 92 is now described.

Inertial information of motion of the base 22 is provided to stabilize the line-of-sight. The tachometer feedback control algorithm 92 developed below addresses decoupling between the positioners 30, 34, 38 without regard to elevation angles. Those skilled in the art will recognize that the dynamics do not change from the equations derived above, but the kinematics do. For demonstrative purposes only, inertia tensors of each of the positioners 30, 34, 38 are shown below:

$$I_{EL} = \begin{bmatrix} 23 & 0 & 0 \\ 0 & [24] & 0 \\ 0 & 0 & 18 \end{bmatrix} in - lbf - s^2,$$

$$I_{XL} = \begin{bmatrix} [39] & 0 & 0 \\ 0 & 63 & 0 \\ 0 & 0 & 56 \end{bmatrix} in - lbf - s^2,$$

$$I_{AZ} = \begin{bmatrix} 129 & 0 & 0 \\ 0 & 149 & 0 \\ 0 & 0 & [83] \end{bmatrix} in - lbf - s^2$$

Bracketed numbers represent the motor axis. Using the kinematics developed above, the measurement equation becomes:

$$\begin{Bmatrix} \Psi \\ \dot{\chi} \\ \dot{\theta} \end{Bmatrix} = \begin{bmatrix} 1 & 0 & 0 \\ s(\gamma) & 1 & 0 \\ -c(\gamma)s(\chi) & 0 & 1 \end{bmatrix} \begin{Bmatrix} \omega_A \\ \omega_X \\ \omega_E \end{Bmatrix}$$

The dynamics are the same and, accordingly, are substituted into the measurement equation to produce the following:

$$\begin{Bmatrix} \Psi \\ \dot{\chi} \\ \dot{\theta} \end{Bmatrix} =$$

$$\begin{bmatrix} 1 & 0 & 0 \\ s(\gamma) & 1 & 0 \\ -c(\gamma)s(\chi) & 0 & 1 \end{bmatrix} \frac{1}{S} \begin{bmatrix} \frac{J_X}{J_A J_X - A^2} & \frac{-A + J_X s(\gamma)}{J_A J_X - A^2} & \frac{-J_X c(\gamma)s(\chi)}{J_A J_X - A^2} \\ \frac{-A}{J_A J_X - A^2} & \frac{-As(\gamma) + J_A}{J_A J_X - A^2} & \frac{Ac(\gamma)s(\chi)}{J_A J_X - A^2} \\ 0 & 0 & \frac{1}{J_E} \end{bmatrix} \begin{Bmatrix} T_A \\ T_X \\ T_E \end{Bmatrix}$$

Simplifying the above equation for easier manipulation produces the following:

$$\begin{Bmatrix} \Psi \\ \dot{\chi} \\ \dot{\theta} \end{Bmatrix} = \begin{bmatrix} 1 & 0 & 0 \\ a & 1 & 0 \\ b & 0 & 1 \end{bmatrix} \frac{1}{S} \begin{bmatrix} d & e & f \\ g & h & i \\ 0 & 0 & j \end{bmatrix} \begin{Bmatrix} T_A \\ T_X \\ T_E \end{Bmatrix}$$

Inserting the $k_{ij}$ matrix into the above equation produces the following:

$$\begin{Bmatrix} \Psi \\ \dot{\chi} \\ \dot{\theta} \end{Bmatrix} = \begin{bmatrix} 1 & 0 & 0 \\ a & 1 & 0 \\ b & 0 & 1 \end{bmatrix} \frac{1}{S} \begin{bmatrix} d & e & f \\ g & h & i \\ 0 & 0 & j \end{bmatrix} \begin{bmatrix} k_{11} & k_{12} & k_{13} \\ k_{21} & k_{22} & k_{23} \\ k_{31} & k_{32} & k_{33} \end{bmatrix} \begin{Bmatrix} U_A \\ U_X \\ U_E \end{Bmatrix}$$

which may then be reduced to:

$$\begin{Bmatrix} \Psi \\ \dot{\chi} \\ \dot{\theta} \end{Bmatrix} = \frac{1}{S} [\text{column1} \quad \text{column2} \quad \text{column3}] \begin{Bmatrix} U_A \\ U_X \\ U_E \end{Bmatrix}$$

$$\text{column1} = \begin{bmatrix} dk_{11} + ek_{21} + fk_{31} \\ (ad + g)k_{11} + (ae + h)k_{21} + (af + i)k_{31} \\ bdk_{11} + bek_{21} + (bf + j)k_{31} \end{bmatrix}$$

$$\text{column2} = \begin{bmatrix} dk_{12} + ek_{22} + fk_{32} \\ (ad + g)k_{12} + (ae + h)k_{22} + (af + i)k_{32} \\ bdk_{12} + bek_{22} + (bf + j)k_{32} \end{bmatrix}$$

$$\text{column2} = \begin{bmatrix} dk_{13} + ek_{23} + fk_{33} \\ (ad + g)k_{13} + (ae + h)k_{23} + (af + i)k_{33} \\ bdk_{13} + bek_{23} + (bf + j)k_{33} \end{bmatrix}$$

Setting the three column matrix above to the identity matrix forms the following three equations:

$$\begin{bmatrix} d & e & f \\ ad + g & ae + h & af + i \\ bd & be & bf + j \end{bmatrix} \begin{Bmatrix} k_{11} \\ k_{21} \\ k_{31} \end{Bmatrix} = \begin{Bmatrix} 1 \\ 0 \\ 0 \end{Bmatrix}$$

-continued $$\begin{bmatrix} d & e & f \\ ad+g & ae+h & af+i \\ bd & be & bf+j \end{bmatrix} \begin{Bmatrix} k_{12} \\ k_{22} \\ k_{32} \end{Bmatrix} = \begin{Bmatrix} 0 \\ 1 \\ 0 \end{Bmatrix}$$

$$\begin{bmatrix} d & e & f \\ ad+g & ae+h & af+i \\ bd & be & bf+j \end{bmatrix} \begin{Bmatrix} k_{13} \\ k_{23} \\ k_{33} \end{Bmatrix} = \begin{Bmatrix} 0 \\ 0 \\ 1 \end{Bmatrix}$$

Solving for $k_{ij}$ produces the following:

$$k_{11}=J_A+J_X s^2\gamma-2As\gamma+J_E c^2\gamma s^2\chi$$

$$k_{21}=A-J_x s\gamma$$

$$k_{31}=J_E c\gamma s\chi$$

$$k_{12}=A-J_X s\gamma$$

$$k_{22}=J_X$$

$$k_{32}=0$$

$$k_{13}=J_E c\gamma s\chi$$

$$k_{23}=0$$

$$k_{33}=J_E$$

In the above equation, $A=(J_z^E-J_x^E)s\theta c\theta c\gamma c\chi$.

The resulting control architecture is shown in the block diagram 97 FIG. 6.

Figure 7A:
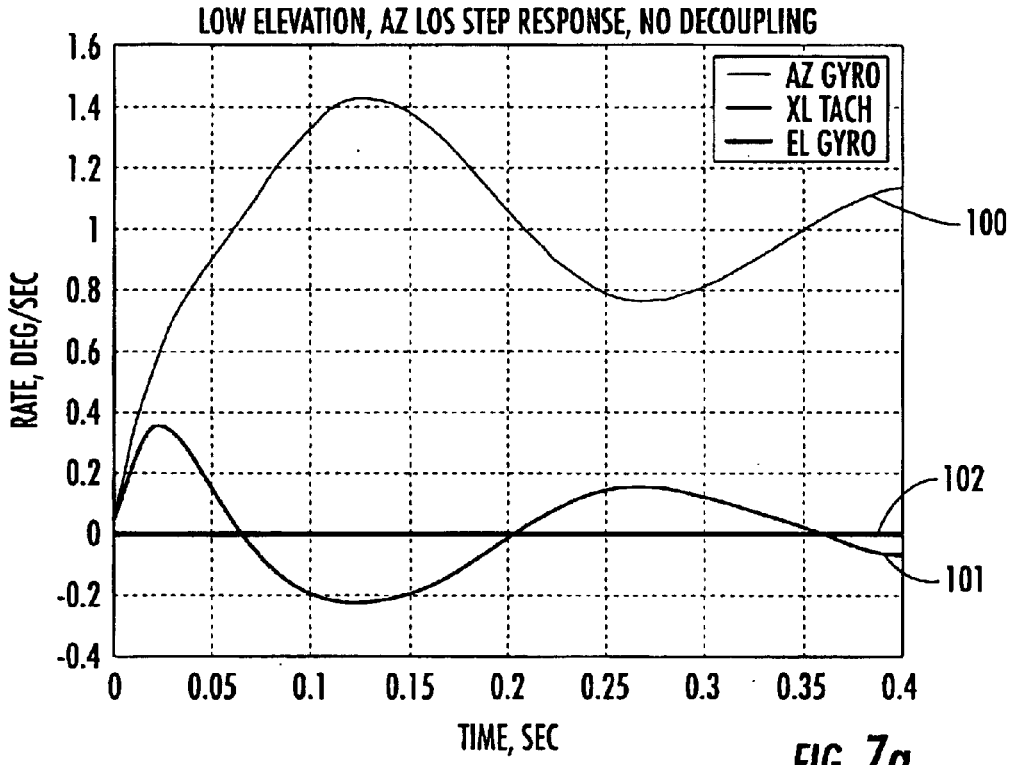
FIG. 7*a* is a graph of operation of an antenna assembly modeled in accordance with the prior art.
Figure 7B:
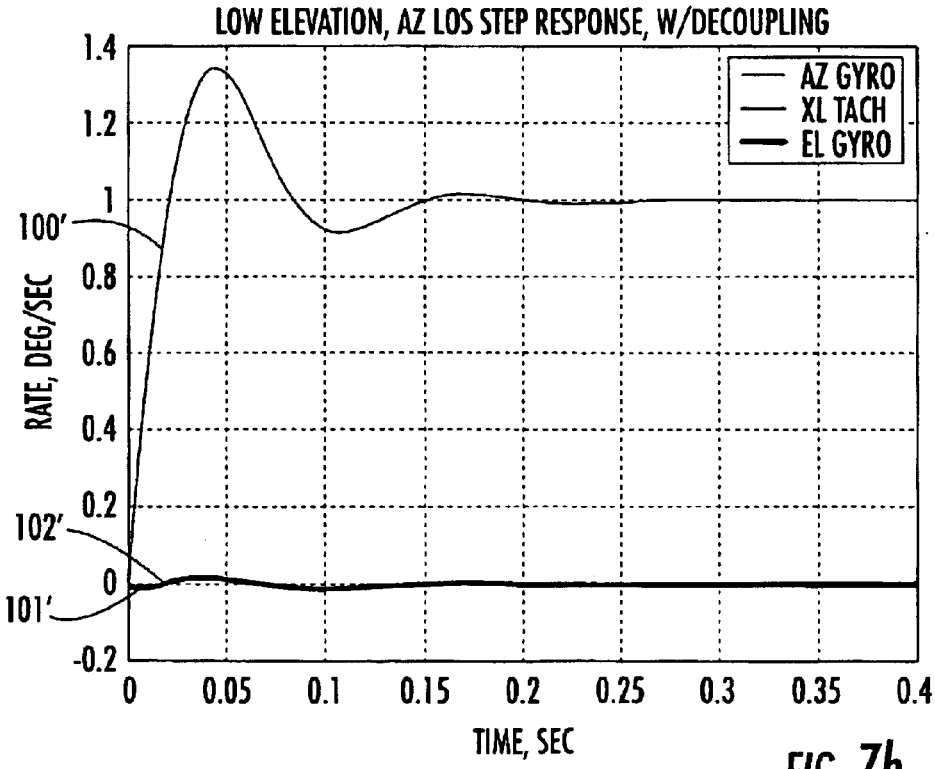
FIG. 7*b* is a graph of operation of an antenna assembly modeled in accordance with the present invention.

Turning now additionally to the graphs of FIGS. 7*a*–15*b*, modeled results of decoupling of the antenna assembly 20 is now described. FIG. 7*a* is a graph of a low elevation, azimuthal line-of-sight step response modeled in accordance with the prior art, and showing an azimuthal gyroscope reading 100, a cross-level tachometer reading 101, and an elevational gyroscope reading 102. FIG. 7*b* is a graph of a low elevation, azimuthal line-of-sight step response modeled in accordance with the present invention, and showing the results of decoupling. More particularly, the resulting gyroscope reading 100', cross-level tachometer reading 101', and elevational gyroscope reading 102' are shown. The oscillations of the canted cross-level positioner 34 have illustratively been removed, and the azimuthal positioner 30 illustratively settles to its desired rate.

Figure 8A:
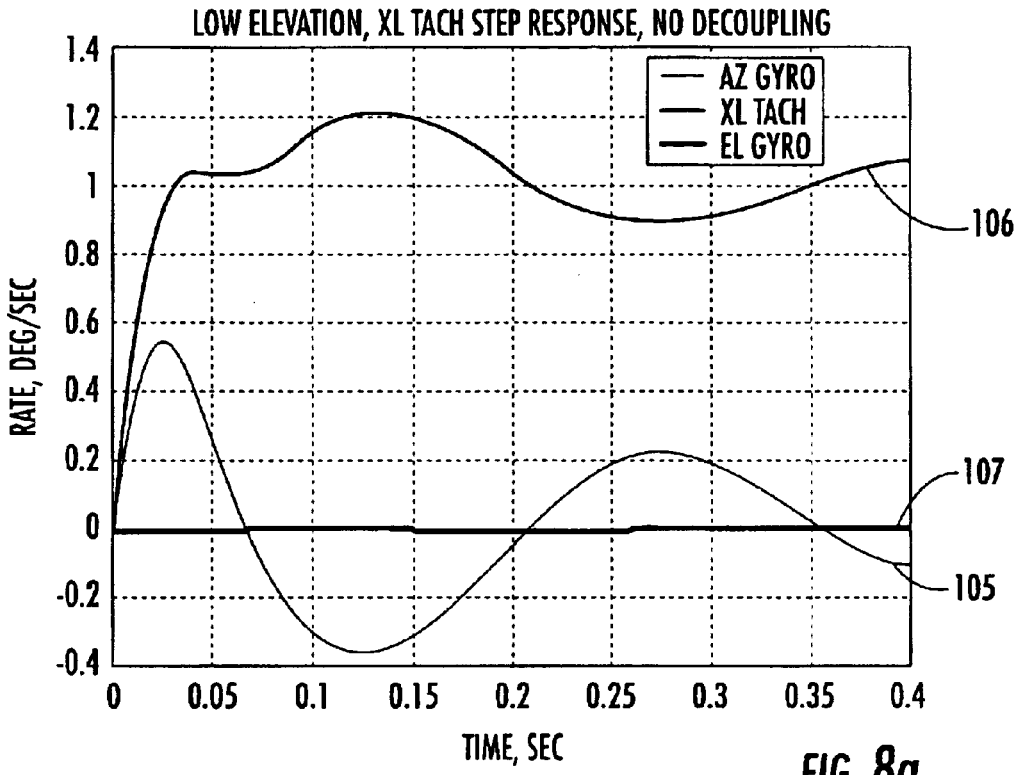
FIG. 8*a* is a graph of operation of an antenna assembly modeled in accordance with the prior art.
Figure 8B:
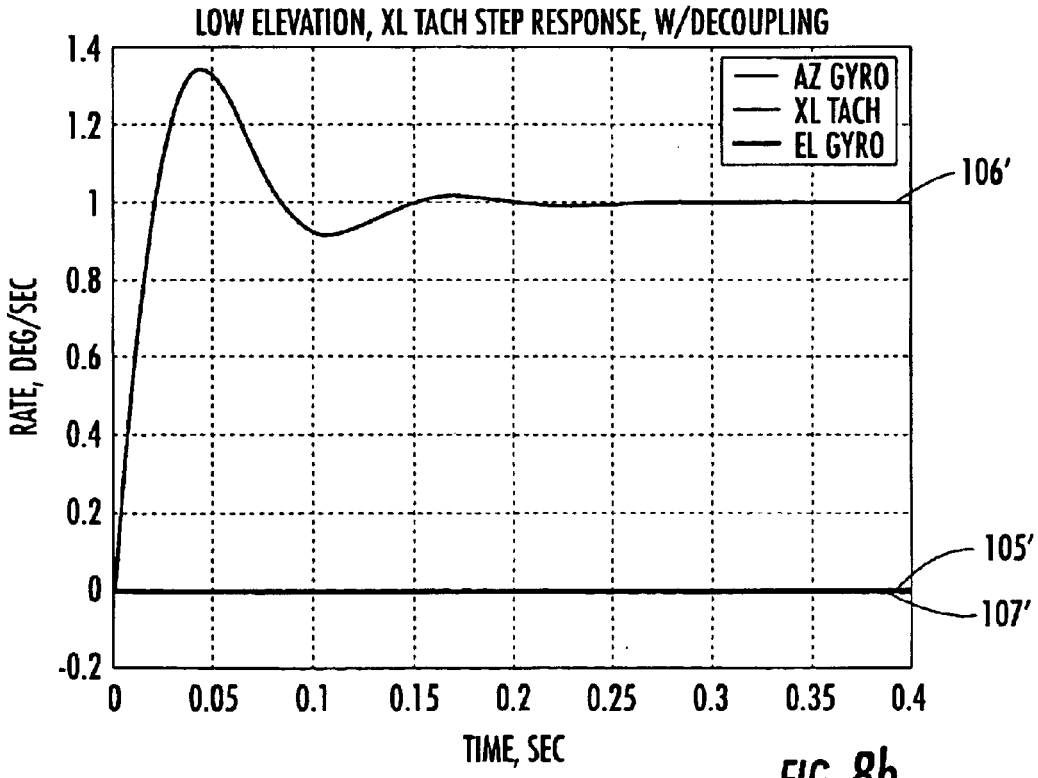
FIG. 8*b* is a graph of operation of an antenna assembly modeled in accordance with the present invention.

FIG. 8*a* is a graph of a low elevation cross-level tachometer step response modeled in accordance with the prior art showing an azimuthal gyroscope reading 105, a cross-level tachometer reading 106, and an elevational gyroscope reading 107. FIG. 8*b* is a graph of a low elevation, cross-level tachometer step response modeled in accordance with the present invention, and showing the results of decoupling. More particularly, the resulting azimuthal gyroscope reading 105', cross-level tachometer reading 106', and elevational gyroscope reading 107' are shown. The oscillations of the azimuthal positioner 30 have illustratively been removed, and the canted cross-level positioner 34 more quickly settles to its desired rate.

Figure 9A:
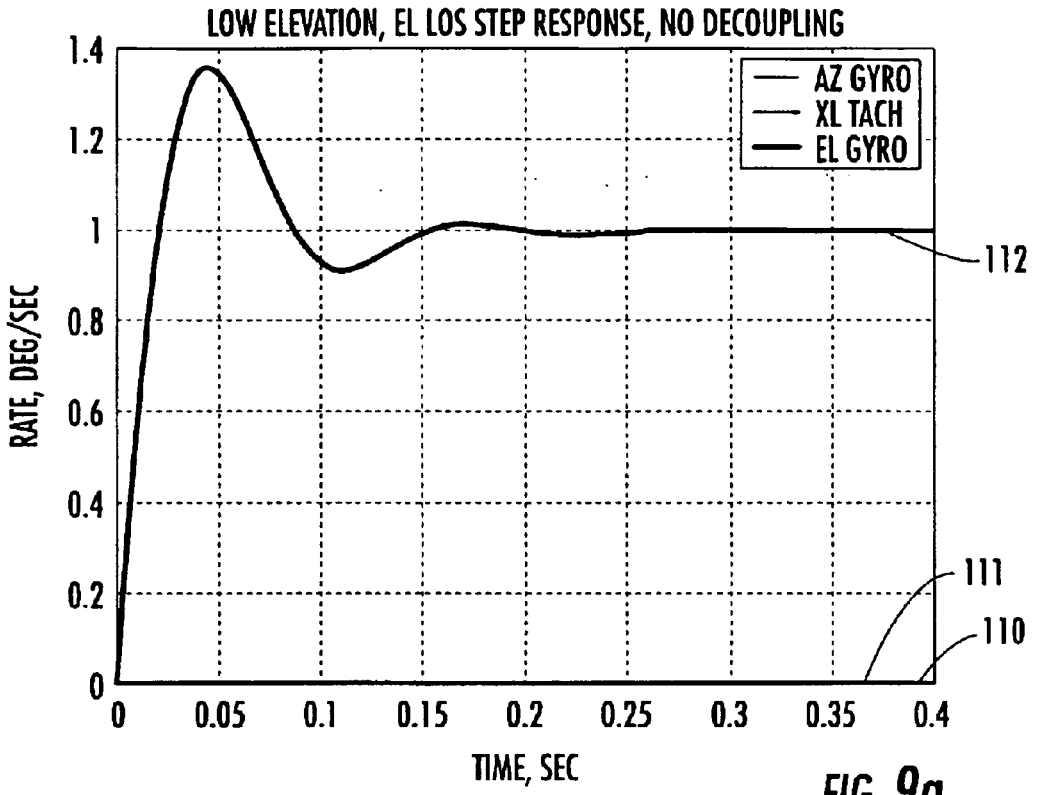
FIG. 9*a* is a graph of operation of an antenna assembly modeled in accordance with the prior art.
Figure 9B:
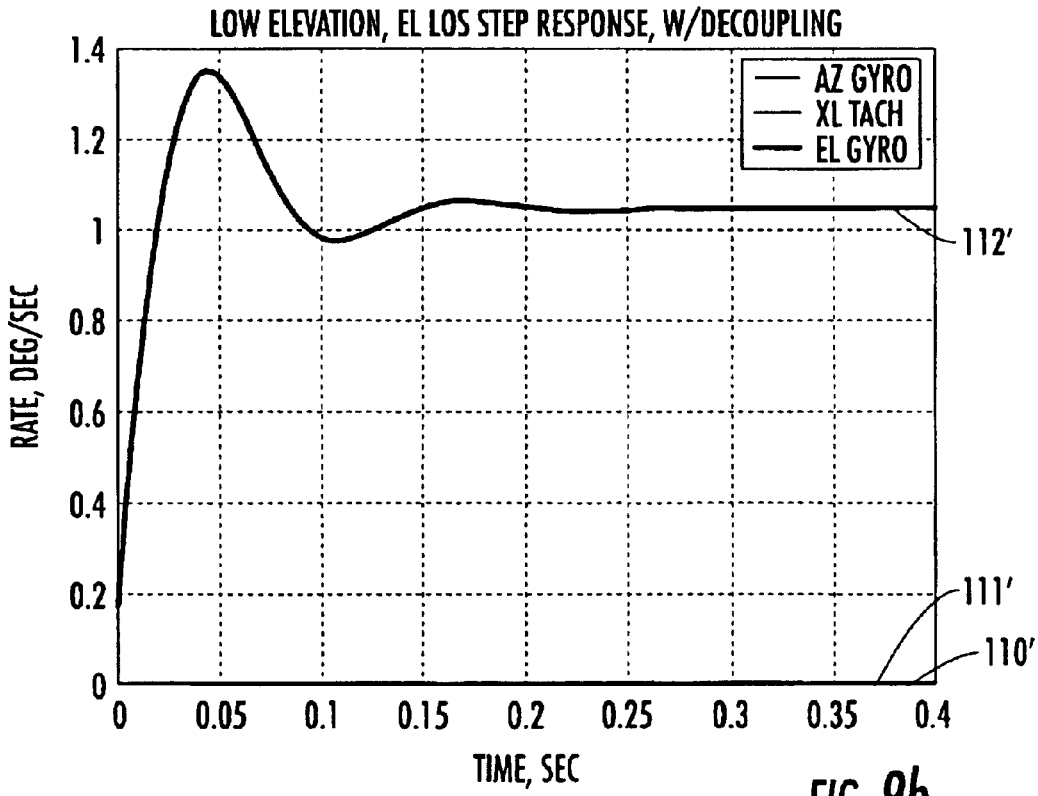
FIG. 9*b* is a graph of operation of an antenna assembly modeled in accordance with the present invention.

FIG. 9*a* is a graph of a low elevation, elevational line-of-sight step response modeled in accordance with the prior art, and showing an azimuthal gyroscope reading 110, a cross-level tachometer reading 111, and an elevational gyroscope reading 112. FIG. 9*b* is a graph of a low elevation, elevational line-of-sight step response modeled in accordance with the present invention, and showing the results of decoupling. More particularly, the resulting azimuthal gyroscope reading 110', cross-level tachometer reading 111', and elevational gyroscope reading 112' are shown. The oscillations of the elevational positioner 38 have illustratively been removed.

Figure 10A:
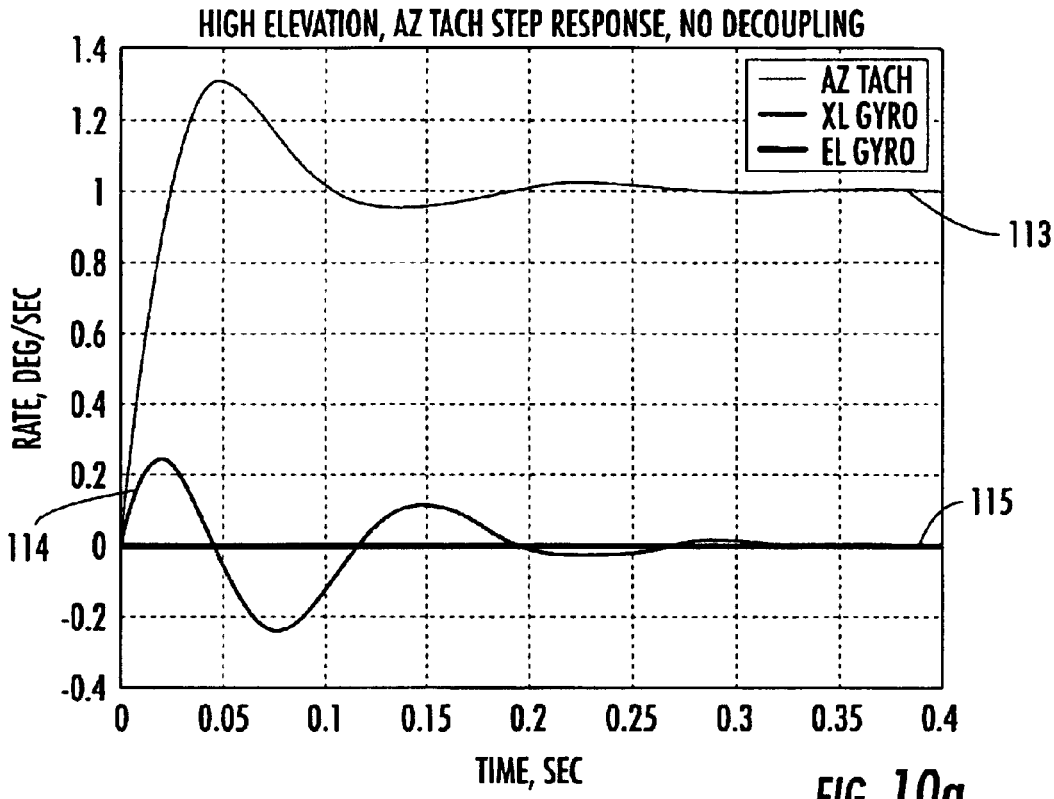
FIG. 10*a* is a graph of operation of an antenna assembly modeled in accordance with the prior art.
Figure 10B:
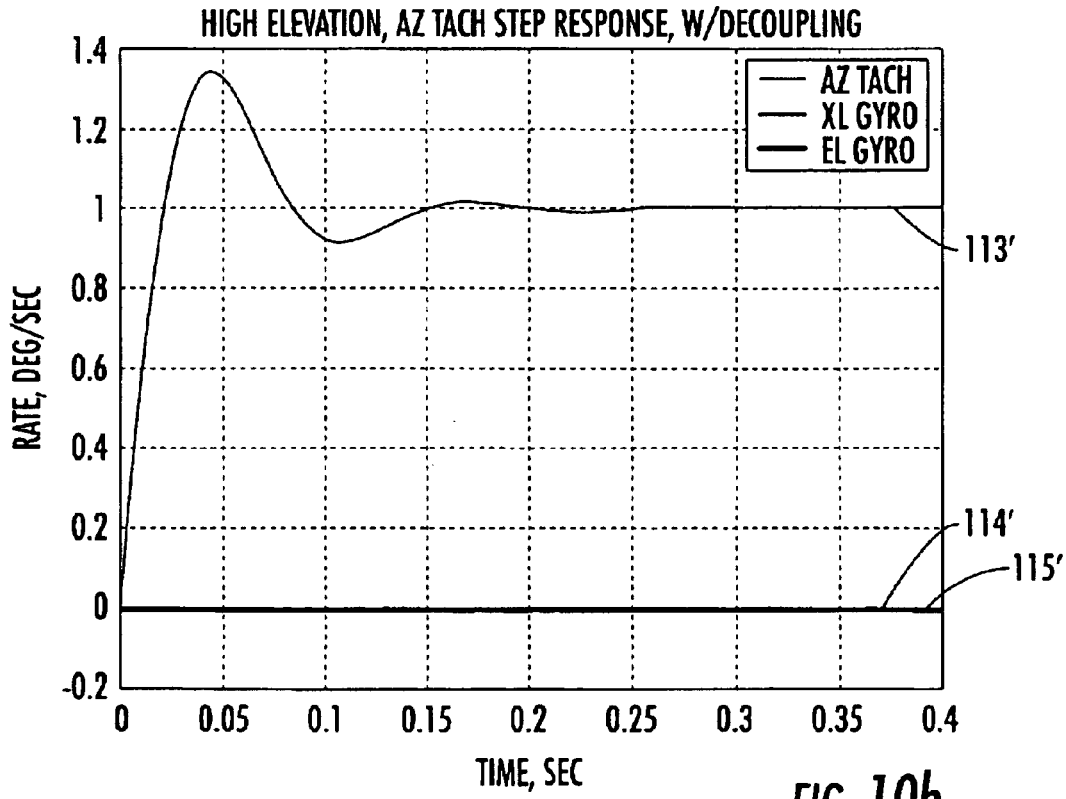
FIG. 10*b* is a graph of operation of an antenna assembly modeled in accordance with the present invention.

FIG. 10*a* is a graph of a high elevation, azimuthal line-of-sight step response modeled in accordance with the prior art, and showing an azimuthal tachometer reading 113, a cross-level gyroscope reading 114, and an elevational gyroscope reading 115. FIG. 10*b* is a graph of a high elevation, azimuthal line-of-sight step response modeled in accordance with the present invention, and showing the results of decoupling. More particularly, the resulting azimuthal tachometer reading 113', cross-level gyroscope reading 114', and elevational gyroscope reading 115' are shown. The oscillations of the azimuthal positioner 30 have illustratively been removed, and the canted cross-level positioner 34 more quickly settles to its desired rate.

Figure 11A:
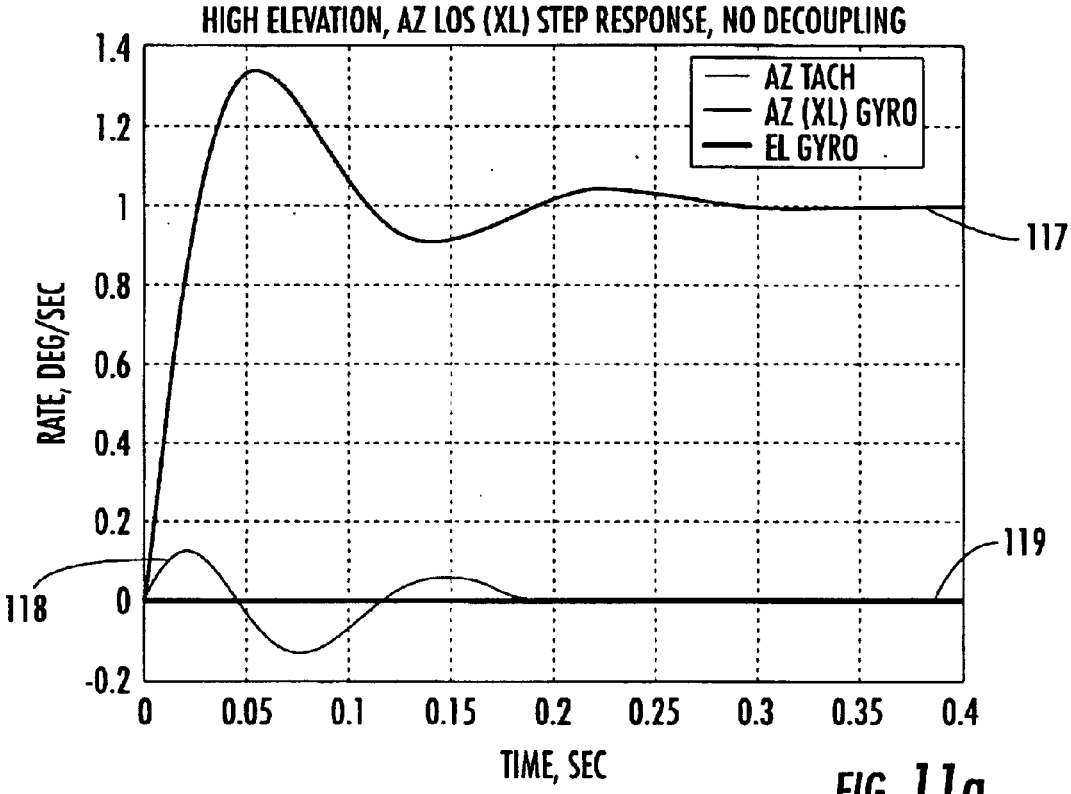
FIG. 11*a* is a graph of operation of an antenna assembly modeled in accordance with the prior art.
Figure 11B:
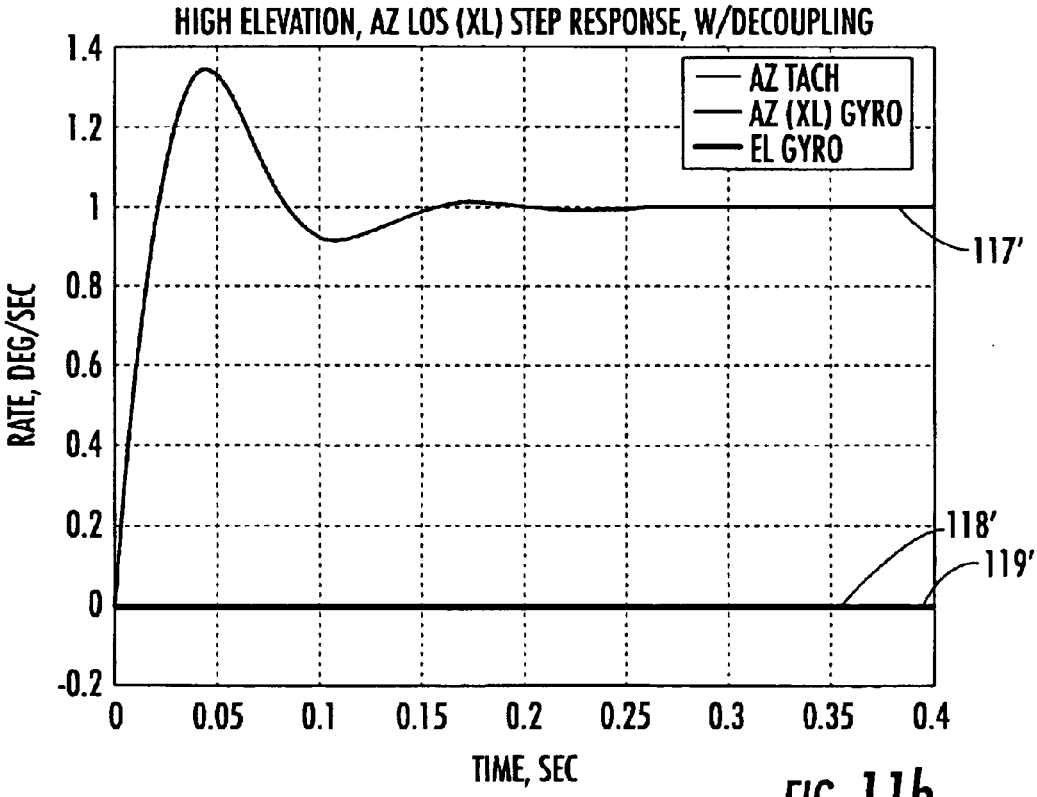
FIG. 11*b* is a graph of operation of an antenna assembly modeled in accordance with the present invention.

FIG. 11*a* is a graph of a high elevation azimuthal line-of-sight step response modeled in accordance with the prior art, and showing an azimuthal tachometer reading 118, an azimuthal gyroscope reading 117, and an elevational gyroscope reading 119. FIG. 11*b* is a graph of a high elevation, azimuthal line-of-sight step response modeled in accordance with the present invention, and showing the results of decoupling. More particularly, the resulting azimuthal tachometer reading 118', azimuthal gyroscope reading 117', and elevational gyroscope reading 119' are shown. The oscillations of the azimuthal positioner 30 have illustratively been removed.

Figure 12A:
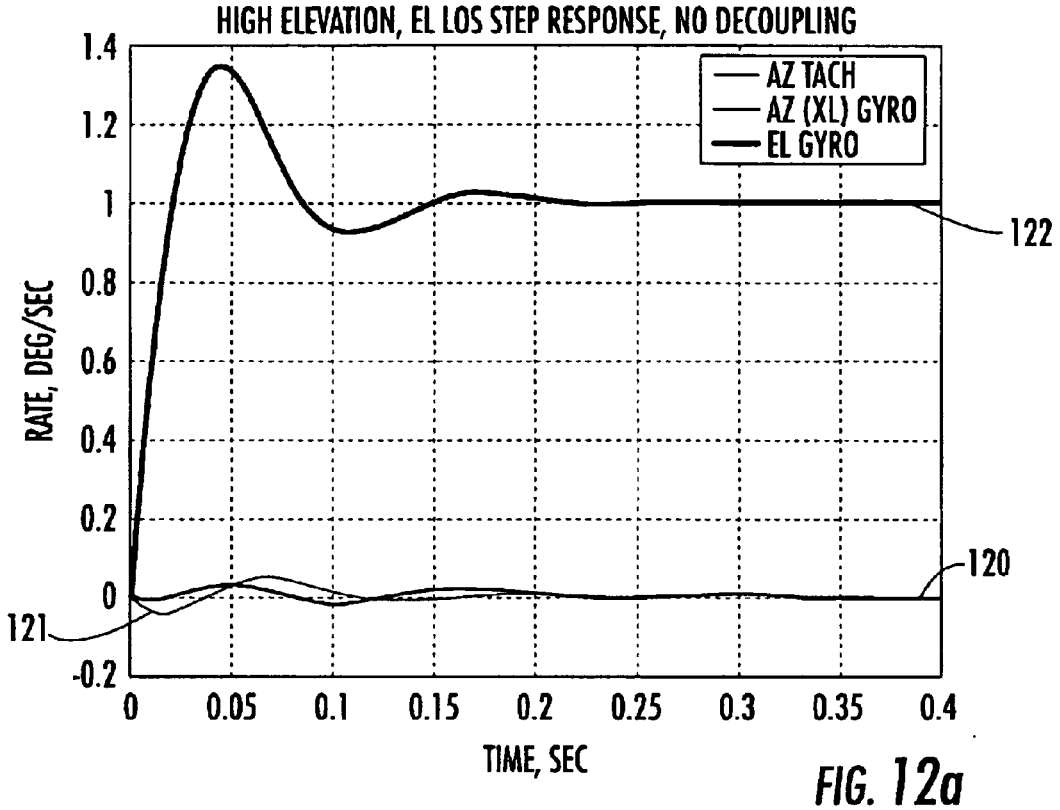
FIG. 12*a* is a graph of operation of an antenna assembly modeled in accordance with the prior art.
Figure 12B:
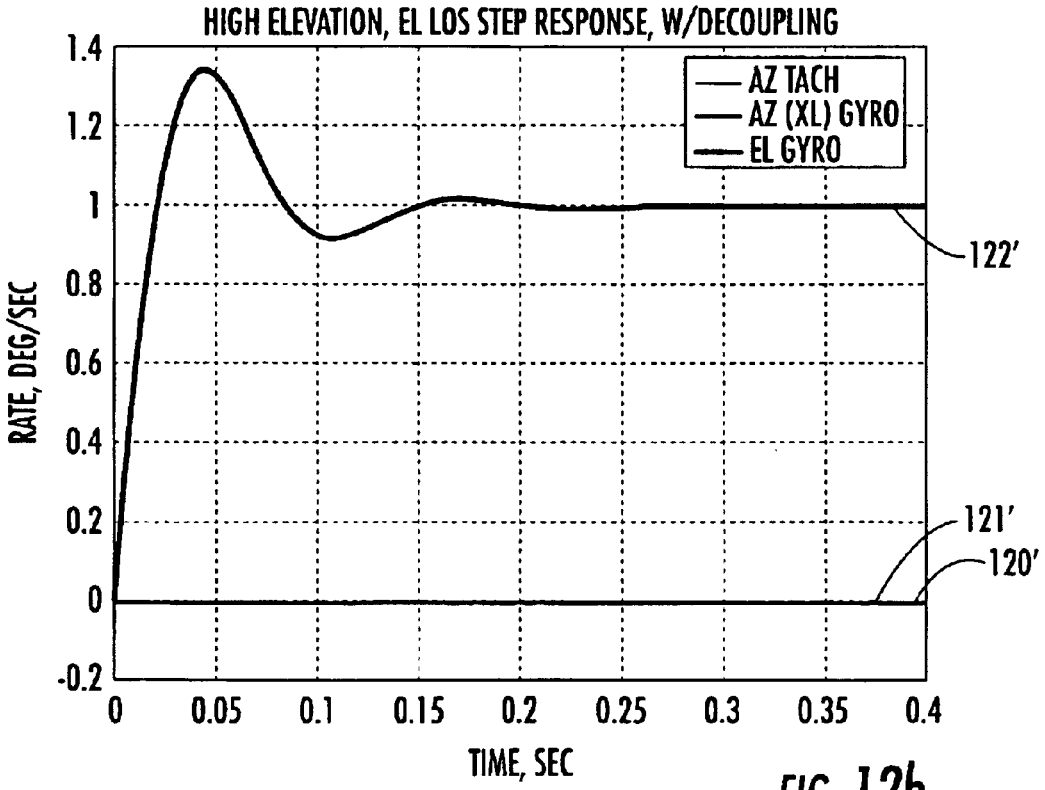
FIG. 12*b* is a graph of operation of an antenna assembly modeled in accordance with the present invention.

FIG. 12*a* is a graph of a high elevation, elevational line-of-sight step response modeled in accordance with the prior art, and showing an azimuthal tachometer reading 121, an azimuthal gyroscope reading 120, and an elevational gyroscope reading 122. FIG. 12*b* is a graph of a high elevation, elevational line-of-sight step response, modeled in accordance with the present invention, and showing the results of decoupling. More particularly, the resulting azimuthal tachometer reading 121', azimuthal gyroscope reading 120', and elevational gyroscope reading 122' are shown. The oscillations of the azimuthal positioner 30 have illustratively been removed.

Figure 13A:
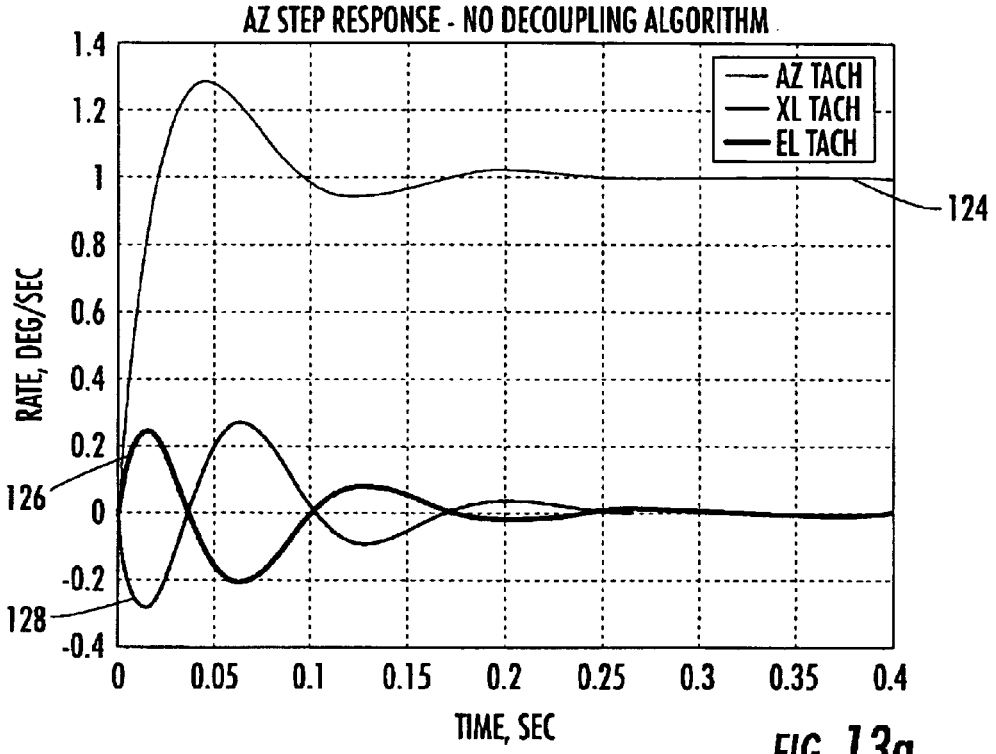
FIG. 13*a* is a graph of operation of an antenna assembly modeled in accordance with the prior art.
Figure 13B:
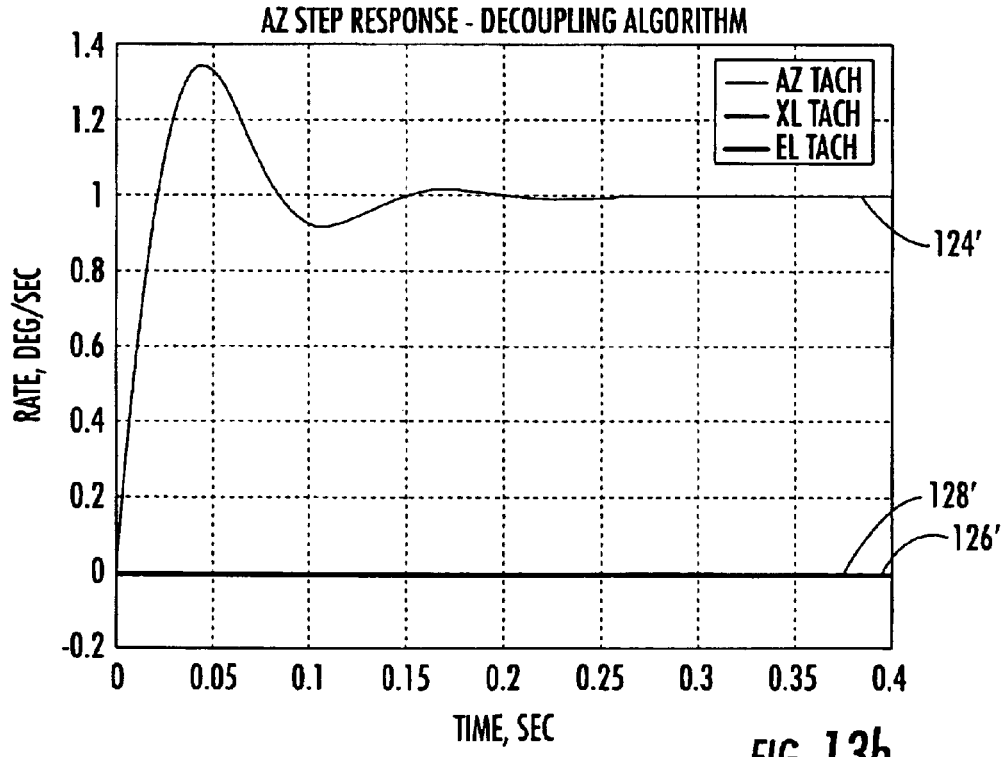
FIG. 13*b* is a graph of operation of an antenna assembly modeled in accordance with the present invention.

FIG. 13*a* is a graph of an azimuthal step response modeled in accordance with the prior art, and showing an azimuthal tachometer reading 124, a cross-level tachometer reading 126, and an elevational tachometer reading 128. FIG. 13*b* is a graph of an azimuthal step response modeled in accordance with the present invention, and showing the results of decoupling. More particularly, the resulting azimuthal tachometer reading 124', cross-level tachometer reading 126', and elevational tachometer reading 128' are shown. The oscillations of the canted cross-level positioner 34 and the elevational positioner 38 have been removed.

Figure 14A:
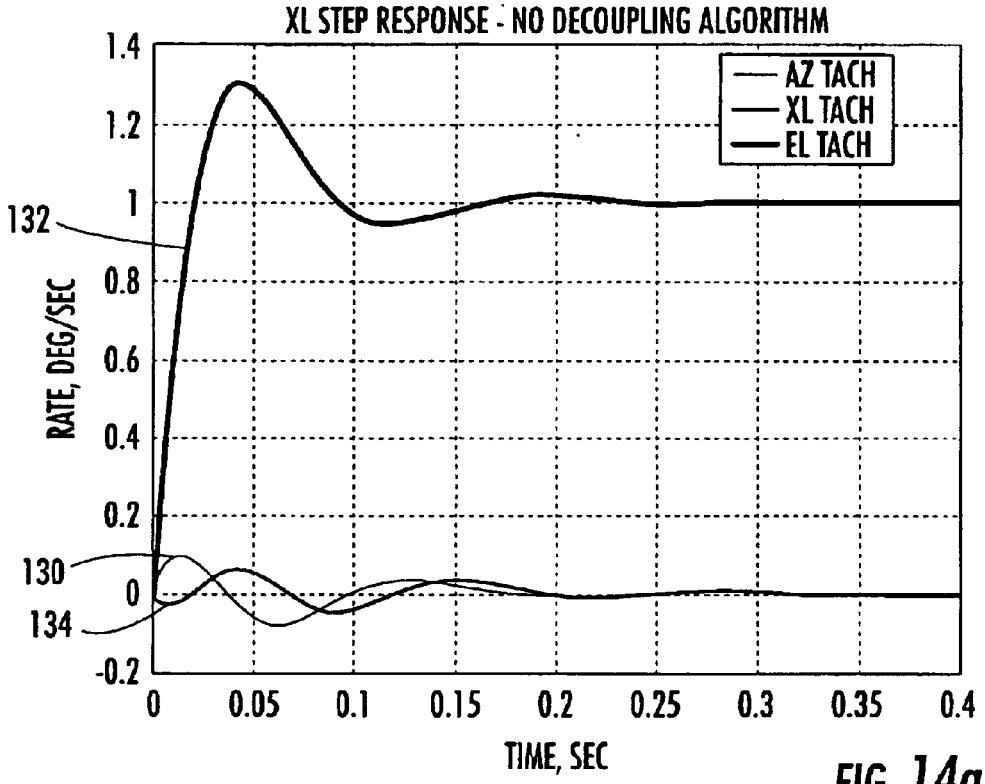
FIG. 14*a* is a graph of operation of an antenna assembly modeled in accordance with the prior art.
Figure 14B:
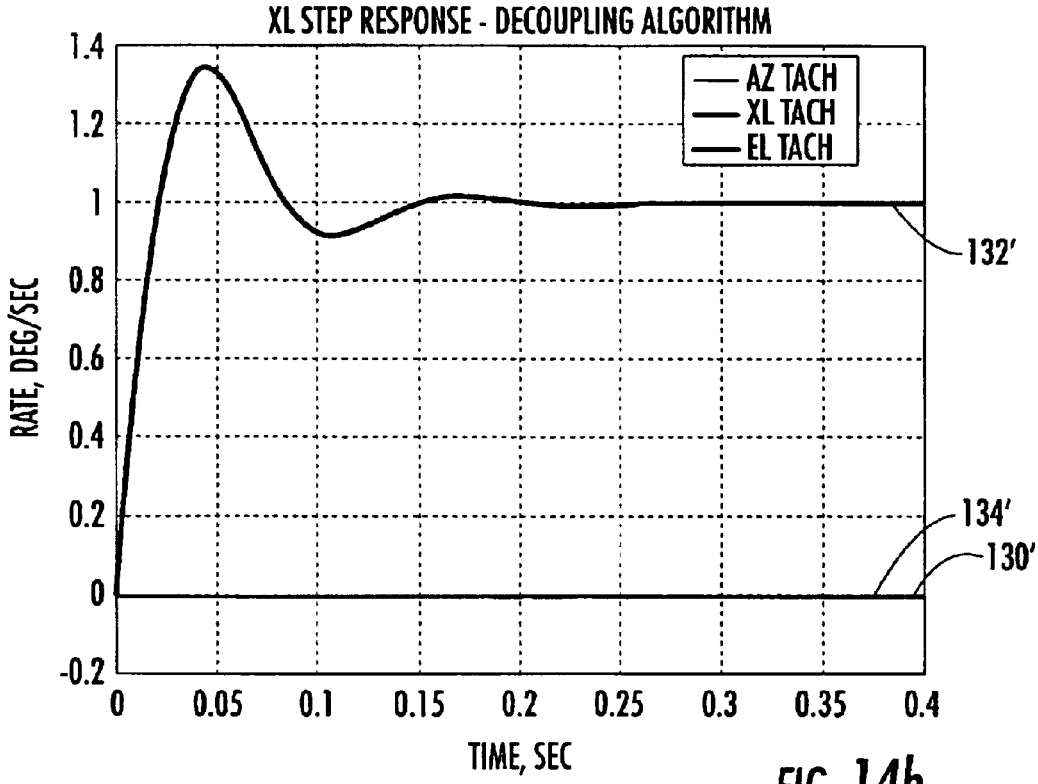
FIG. 14*b* is a graph of operation of an antenna assembly modeled in accordance with the present invention.

FIG. 14*a* is a graph of a cross-level step response modeled in accordance with the prior art, and showing an azimuthal tachometer reading 130, a cross-level tachometer reading 132, and an elevational tachometer reading 134. FIG. 14*b* is a graph of a cross-level step response modeled in accordance with the present invention, and showing the results of decoupling. More particularly, the resulting azimuthal tachometer reading 130', cross-level tachometer reading 132', and elevational tachometer reading 134' are shown. The oscillations of the azimuthal positioner 30 and the elevational positioner 38 have illustratively been removed.

Figure 15A:
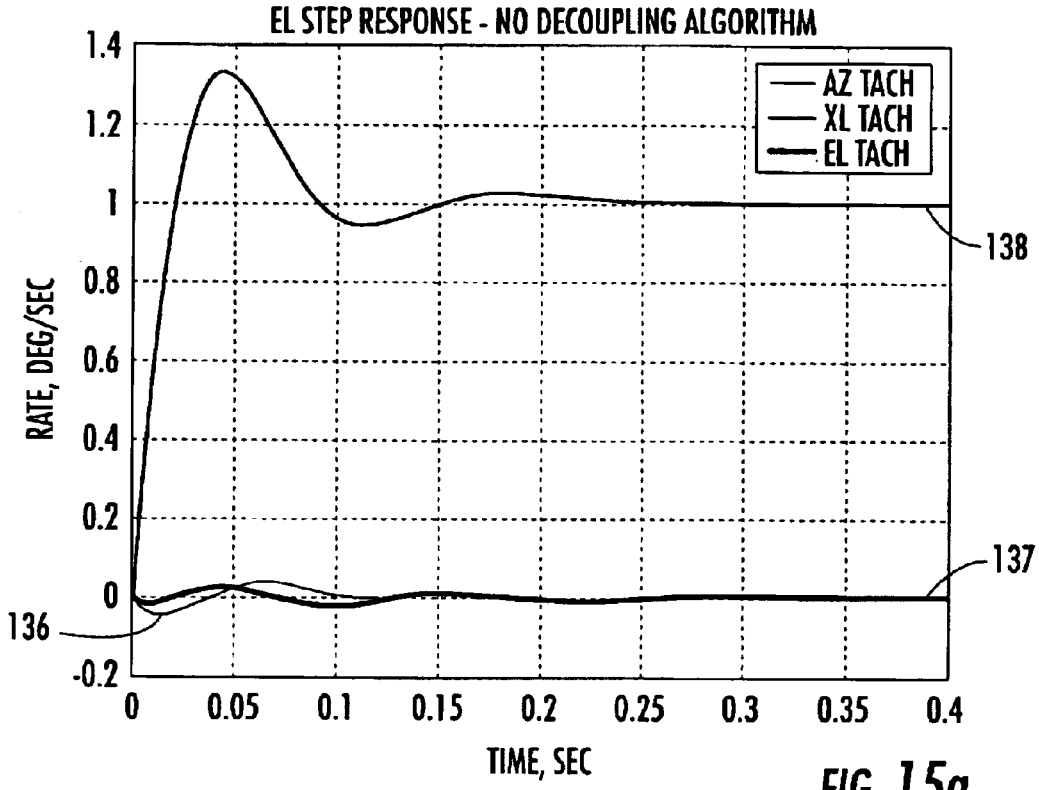
FIG. 15*a* is a graph of operation of an antenna assembly modeled in accordance with the prior art.
Figure 15B:
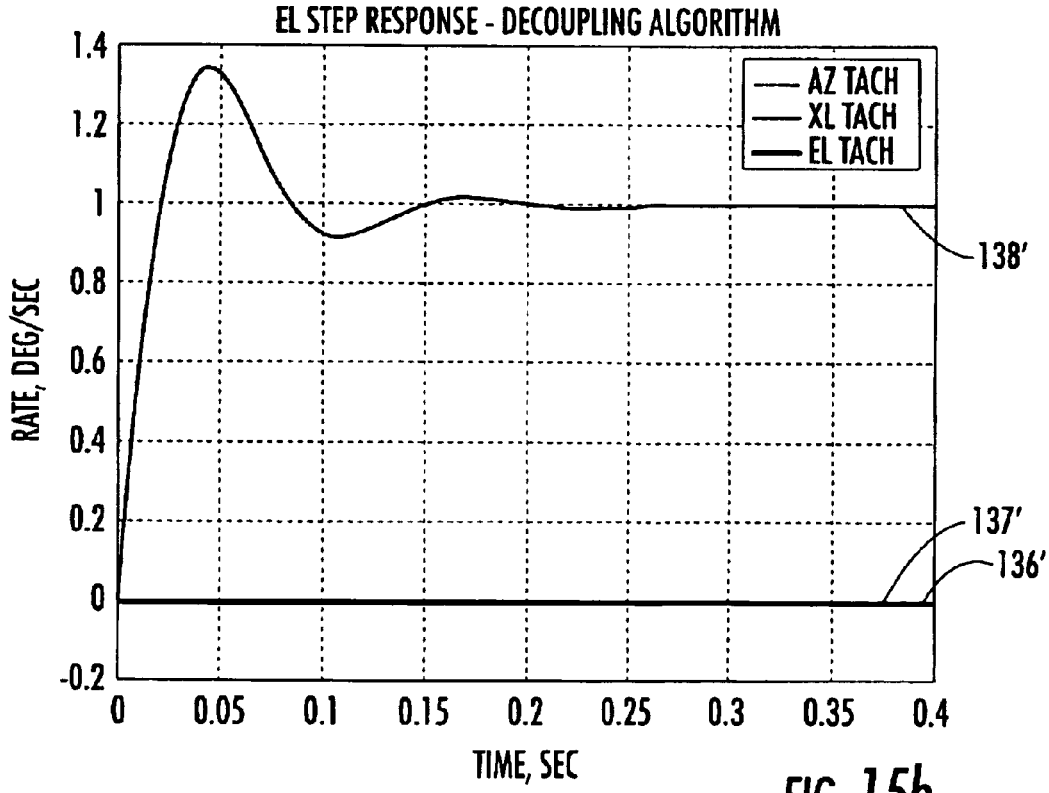
FIG. 15*b* is a graph of operation of an antenna assembly modeled in accordance with the present invention.

FIG. 15*a* is a graph of an elevational step response modeled in accordance with the prior art, and showing an azimuthal tachometer reading 136, a cross-level tachometer reading 137, and an elevational tachometer reading 138. FIG. 15*b* is a graph of an elevational step response modeled in accordance with the present invention, and showing the results of decoupling. More particularly, the resulting azimuthal tachometer reading 136', cross-level tachometer reading 137', and elevational tachometer reading 138' are shown. Oscillations of the azimuthal positioner 30 and the canted cross-level positioner 34 have illustratively been removed.

A method aspect of the present invention is for operating an antenna assembly 20 comprising a plurality of positioners and a controller 50. The plurality of positioners comprises at least first and second positioners non-orthogonally connected together, thereby coupling the first and second positioners to one another. The method comprises controlling the positioners to aim an antenna 40 connected thereto along a desired line-of-sight and while decoupling the at least first and second positioners.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that other modifications and embodiments are intended to be included within the scope of the appended claims.

That which is claimed is:

1. An antenna assembly for operation on a moving platform comprising:

a base to be mounted on the moving platform;

an azimuthal positioner extending upwardly from said base;

a canted cross-level positioner extending from said azimuthal positioner at a cross-level cant angle canted from perpendicular, said canted cross-level positioner being rotatable about a cross level axis to define a roll angle resulting in coupling between said canted cross-level positioner and said azimuthal positioner;

an elevational positioner connected to said canted cross-level positioner resulting in coupling between said elevational positioner and said azimuthal positioner because of said roll angle;

an antenna connected to said elevational positioner; and a controller for operating said azimuthal, canted cross-level, and elevational positioners to aim said antenna along a desired line-of-sight and while decoupling at least one of said azimuthal and canted cross-level positioners, and said azimuthal and elevational positioners.

2. An antenna assembly according to claim 1 further comprising an azimuthal gyroscope associated with said elevational positioner; wherein said canted cross-level positioner comprises a cross-level motor and cross-level tachometer associated therewith; and wherein said controller decouples based upon said azimuthal gyroscope and said cross-level tachometer.

3. An antenna assembly according to claim 2 wherein said controller decouples based upon the roll angle and an elevation angle defined by the desired line-of-sight being within respective predetermined ranges.

4. An antenna assembly according to claim 1 further comprising a cross-level gyroscope associated with said elevational positioner; wherein said azimuthal positioner comprises an azimuthal motor and an azimuthal tachometer associated therewith; and wherein said controller decouples based upon said cross-level gyroscope and said azimuthal tachometer.

5. An antenna assembly according to claim 4 wherein said controller decouples based upon the roll angle and an elevation angle defined by the desired line-of-sight being within respective predetermined ranges.

6. An antenna assembly according to claim 1 wherein each of said azimuthal, canted cross-level, and elevational positioners comprises respective motors and tachometers associated therewith; and wherein said controller decouples based upon said tachometers.

7. An antenna assembly according to claim 6 wherein said controller decouples based upon the roll angle and an elevation angle.

8. An antenna assembly according to claim 1 further comprising an azimuthal gyroscope, a cross level gyroscope, and an elevational gyroscope associated with said elevational positioner.

9. An antenna assembly according to claim 1 wherein each of said azimuthal, canted cross-level, and elevational positioners comprises a motor and tachometer associated therewith.

10. An antenna assembly according to claim 1 wherein said antenna comprises a reflector antenna.

11. An antenna assembly for operation on a moving platform comprising:

a base to be mounted on the moving platform;

an azimuthal positioner extending upwardly from said base, said azimuthal positioner comprising an azimuthal motor and an azimuthal tachometer associated therewith;

a canted cross-level positioner extending from said azimuthal positioner at a cross-level cant angle canted from perpendicular, said canted cross-level positioner being rotatable about a cross-level axis to define a roll angle resulting in coupling between said canted cross-level positioner and said azimuthal positioner, said canted cross-level positioner comprising a cross-level motor and a cross-level tachometer associated therewith;

an elevational positioner connected to said canted cross-level positioner resulting in coupling between said elevational positioner and said azimuthal positioner because of said roll angle, said elevational positioner comprising an azimuthal gyroscope, a canted cross-level gyroscope, an elevational gyroscope, an elevational motor and an elevational tachometer associated therewith;

an antenna connected to said elevational positioner; and a controller for operating said azimuthal, canted cross-level, and elevational positioners to aim said antenna along a desired line-of-sight and while decoupling at least one of said azimuthal and canted cross-level positioners, and said azimuthal and elevational positioners based upon at least some of said gyroscopes and tachometers.

12. An antenna assembly according to claim 11 wherein said controller decouples based upon said azimuthal gyroscope and said cross-level tachometer.

13. An antenna assembly according to claim 11 wherein said controller decouples based upon said cross-level gyroscope and said azimuthal tachometer.

14. An antenna assembly according to claim 11 wherein said controller decouples based upon said azimuthal, cross-level, and elevational tachometers.

15. An antenna assembly according to claim 11 wherein said antenna comprises a reflector antenna.

16. An antenna positioning assembly for operation on a moving platform comprising:

a plurality of positioners comprising at least first and second positioners non-orthogonally connected together thereby coupling said first and second positioners to one another; and a controller for operating said positioners to aim an antenna along a desired line-of-sight and while decoupling the at least first and second positioners.

17. An antenna positioning assembly according to claim 16 wherein said first positioner comprises an azimuthal positioner; wherein said second positioner comprises a canted cross-level positioner extending from said azimuthal positioner resulting in coupling therebetween; further comprising an azimuthal gyroscope; wherein said canted cross-level positioner comprises a cross-level motor and cross-level tachometer associated therewith; and wherein said controller decouples based upon said azimuthal gyroscope and said cross-level tachometer.

18. An antenna positioning assembly according to claim 16 wherein said first positioner comprises an azimuthal positioner; wherein said second positioner comprises a canted cross-level positioner extending from said azimuthal positioner resulting in coupling therebetween; further comprising a cross-level gyroscope; wherein said azimuthal positioner comprises an azimuthal motor and an azimuthal tachometer associated therewith; and wherein said controller decouples based upon said cross-level gyroscope and said azimuthal tachometer.

19. An antenna positioning assembly according to claim 16 wherein said first positioner comprises an azimuthal positioner; wherein said second positioner comprises a canted cross-level positioner extending from said azimuthal positioner at a cross-level cant angle canted from perpendicular and rotatable about a cross-level axis to define a roll angle resulting in coupling therebetween; wherein said plurality of positioners further comprises an elevational positioner connected to said canted cross-level positioner resulting in coupling between said elevational positioner and said azimuthal positioner because of said roll angle; wherein each of said azimuthal, canted cross-level, and elevational positioners comprises respective motors and tachometers associated therewith; and wherein said controller decouples based upon said tachometers.

20. An antenna positioning assembly according to claim 16 wherein said first positioner comprises an azimuthal positioner; wherein said second positioner comprises a canted cross-level positioner extending from said azimuthal positioner at a cross-level cant angle canted from perpendicular and rotatable about a cross-level axis to define a roll angle resulting in coupling therebetween; wherein said plurality of positioners further comprises an elevational positioner connected to said canted cross-level positioner resulting in coupling between said elevational positioner and said azimuthal positioner because of said roll angle.

21. An antenna positioning assembly according to claim 20 wherein each of said elevational positioner comprises an azimuthal gyroscope, a canted cross-level gyroscope, and an elevational gyroscope associated therewith.

22. An antenna positioning assembly according to claim 20 wherein each of said azimuthal, canted cross-level, and elevational positioners comprises a motor and tachometer associated therewith.

23. A method for operating an antenna assembly comprising a plurality of positioners, the plurality of positioners comprising at least first and second positioners non-orthogonally connected together thereby coupling the first and second positioners to one another, the method comprising:

controlling the positioners to aim an antenna connected thereto along a desired line-of-sight and while decoupling the at least first and second positioners.

24. A method according to claim 23 wherein the first positioner comprises an azimuthal positioner; wherein the second positioner comprises a canted cross-level positioner extending from the azimuthal positioner at a cross-level cant angle canted from perpendicular and rotatable about a cross-level axis to define a roll angle resulting in coupling therebetween; wherein the antenna assembly comprises an azimuthal gyroscope; wherein the canted cross-level positioner comprises a cross-level motor and cross-level tachometer associated therewith; and wherein controlling is based upon the azimuthal gyroscope and the cross-level tachometer.

25. A method according to claim 23 wherein the first positioner comprises an azimuthal positioner; wherein the second positioner comprises a canted cross-level positioner extending from the azimuthal positioner at a cross-level cant angle canted from perpendicular and rotatable about a cross-level axis to define a roll angle resulting in coupling therebetween; wherein the antenna assembly comprises a cross-level gyroscope; wherein the azimuthal positioner comprises an azimuthal motor and an azimuthal tachometer associated therewith; and wherein controlling is based upon the cross-level gyroscope and the azimuthal tachometer.

26. A method according to claim 23 wherein the first positioner comprises an azimuthal positioner; wherein the second positioner comprises a canted cross-level positioner extending from the azimuthal positioner at a cross-level cant angle canted from perpendicular and rotatable about a cross-level axis to define a roll angle resulting in coupling therebetween; wherein the plurality of positioners further comprises an elevational positioner connected to the canted cross-level positioner resulting in coupling between the elevational positioner and the azimuthal positioner because of the roll angle; wherein each of the azimuthal, canted cross-level, and elevational positioners comprises respective motors and tachometers associated therewith; and wherein controlling is based upon the tachometers.

27. A method according to claim 23 wherein the first positioner comprises an azimuthal positioner; wherein the second positioner comprises a canted cross level positioner extending from the azimuthal positioner at a cross-level cant angle canted from perpendicular and rotatable about a cross-level axis to define a roll angle resulting in coupling therebetween; wherein the plurality of positioners further comprises an elevational positioner connected to the canted cross-level positioner resulting in coupling between the elevational positioner and the azimuthal positioner because of the roll angle.

28. A method according to claim 27 wherein the elevational positioner comprises an azimuthal gyroscope, a canted cross-level gyroscope, and elevational gyroscope associated therewith.

29. A method according to claim 27 wherein each of the azimuthal, canted cross-level, and elevational positioners comprises a motor and tachometer associated therewith.

* * * * *